US009167891B2

(12) United States Patent
Shaughness

(10) Patent No.: US 9,167,891 B2
(45) Date of Patent: Oct. 27, 2015

(54) BRUSH COVER

(76) Inventor: Brigitte Kirkconnell Shaughness, Grand Cayman, KY (US)

( * ) Notice: Subject to any disclaimer, the term of this patent is extended or adjusted under 35 U.S.C. 154(b) by 509 days.

(21) Appl. No.: 13/617,797

(22) Filed: Sep. 14, 2012

(65) Prior Publication Data

US 2013/0056377 A1 Mar. 7, 2013

Related U.S. Application Data

(63) Continuation-in-part of application No. 13/267,229, filed on Oct. 6, 2011, now abandoned, which is a continuation of application No. 12/941,522, filed on Nov. 8, 2010, now Pat. No. 8,061,518.

(60) Provisional application No. 61/258,697, filed on Nov. 6, 2009.

(51) Int. Cl.

| | |
|---|---|
| ***B65D 83/10*** | (2006.01) |
| ***A46B 17/04*** | (2006.01) |
| ***B65D 73/00*** | (2006.01) |

(52) U.S. Cl.

CPC ..... *A46B 17/04* (2013.01); *B65D 73/0071* (2013.01); *A46B 2200/1046* (2013.01)

(58) Field of Classification Search

CPC combination set(s) only.

See application file for complete search history.

(56) References Cited

U.S. PATENT DOCUMENTS

| | | | | |
|---|---|---|---|---|
| 1,498,302 | A | 6/1924 | Satake | |
| 1,852,679 | A | 4/1932 | Schneider | |
| 2,216,543 | A | 10/1940 | Schumann | |
| 2,262,753 | A | 11/1941 | Brennan | |
| 2,485,068 | A * | 10/1949 | Santana | 206/361 |
| 3,000,491 | A | 9/1961 | McIntosh | |
| 3,167,178 | A * | 1/1965 | Saunders | 206/361 |
| 5,191,973 | A * | 3/1993 | Shteynberg | 206/15.2 |
| 5,511,654 | A | 4/1996 | de la Rocha | |
| 6,041,919 | A | 3/2000 | Adams | |
| 6,199,694 | B1 * | 3/2001 | Van Diest et al. | 206/361 |
| 7,111,354 | B2 | 9/2006 | Nennig et al. | |
| 7,207,437 | B1 | 4/2007 | Johansson | |
| 8,668,085 | B1 * | 3/2014 | Oliver | 206/361 |
| 2004/0050732 | A1 * | 3/2004 | Baker | 206/361 |
| 2004/0168700 | A1 * | 9/2004 | Dorf | 132/313 |
| 2005/0145518 | A1 * | 7/2005 | Hong | 206/361 |
| 2006/0054527 | A1 * | 3/2006 | Hart et al. | 206/459.5 |
| 2007/0170079 | A1 * | 7/2007 | Gangemi | 206/361 |
| 2007/0199575 | A1 * | 8/2007 | Del Ponte | 132/320 |
| 2013/0111688 | A1 * | 5/2013 | Lim | 15/247 |

* cited by examiner

*Primary Examiner* — Jacob K Ackun

(74) *Attorney, Agent, or Firm* — Ulmer & Berne LLP

(57) ABSTRACT

A protective brush cover is described for use with a makeup brush. In some versions, the protective brush cover comprises a body and a closing feature. In some versions the protective brush cover comprises a body, a lid, and a securing feature. In some versions, the body is operable to hold the head of a makeup brush, and the body may further have an opening such that the handle of the makeup brush may extend through the opening.

18 Claims, 33 Drawing Sheets

BRUSH COVER

CROSS-REFERENCE TO RELATED APPLICATIONS

This application is a continuation-in-part of prior, U.S. patent application Ser. No. 13/267,229, filed Oct. 6, 2011, now abandoned entitled "Brush Cover," which is a continuation of U.S. patent application Ser. No. 12/941,522, now U.S. Pat. No. 8,061,518, filed Nov. 8, 2010, entitled "Brush Cover," which claims priority to U.S. Provisional Patent Application Ser. No. 61/258,697, filed Nov. 6, 2009, entitled "Protective Brush Cover." The disclosures of which are each incorporated by reference herein in their entirety.

FIELD

Versions of the present invention relate generally to protective devices, and more particularly, to covering devices for makeup applicators.

BACKGROUND

Makeup brushes are used to apply makeup, such as foundation or various other powder forms of cosmetics, and come in a wide variety of shapes, sizes, and configurations. These brushes typically come packaged in a plastic cover to enclose the bristles of the makeup brush to prevent damage to the bristles prior to sale of the brush. Before use, the plastic cover is discarded as it is generally unsuitable for later protecting the bristles of the makeup brush. The plastic cover is generally a low quality material that tightly binds the bristles of the brush during transport and prior to sale.

The included plastic cover is unsuitable to store the makeup brush after the initial use because it is very difficult to reattach the plastic cover, which also compresses the bristles of the makeup brush. Over time, repeated use of a makeup brush allows the bristles to expand, providing a better user experience because makeup can be more easily and evenly spread across the surface of the skin. Placing the makeup brush into the plastic cover recompresses the bristles and reduces the benefits of using a makeup brush with full bristles.

Previous solutions for transporting a makeup brush require the user to place the makeup brush in a larger makeup bag, or resealable plastic bag, and place this large bag inside of a purse or other carrying bag. This method is generally cumbersome and undesirable because it consumes too much space within the purse or bag. Additionally, the makeup contained on the bristles may be dislodged during transport, which results in makeup covering the handle or other portions of the brush that may make the brush difficult or messy to use. The makeup brush may also collect dirt and grime during transport, which could transfer dirt and grime to the face during subsequent use. If the brush is simply placed in a purse, or other article, the brush and/or article is likely to become damaged or stained.

BRIEF DESCRIPTION OF THE DRAWINGS

While the specification concludes with claims that particularly point out and distinctly claim the invention, it is believed the expressly disclosed versions of the present invention can be understood from the following description taken in conjunction with the accompanying drawings, in which like reference numerals identify the same elements. The drawings and detailed description which follow are intended to be merely illustrative of the expressly disclosed versions and are not intended to limit the scope of the invention as set forth in the appended claims. In the drawings:

FIGS. 24A-25B depict side elevational views of the brush cover of FIG. 23.

FIGS. 25A-25C depict the progression of an example makeup brush being inserted into a brush cover.

DETAILED DESCRIPTION

The following description should not be used to limit the scope of the protective brush cover. Other examples, features, aspects, versions, and advantages of the protective brush cover will become apparent to those skilled in the art from the following description. As will be realized, the protective brush cover is capable of other different and obvious aspects, all without departing from the protective brush cover as described herein. Accordingly, the drawings and descriptions should be regarded as illustrative in nature and not restrictive. It should therefore be understood that the inventor contemplates a variety of versions that are not explicitly disclosed herein.

Figure 1:
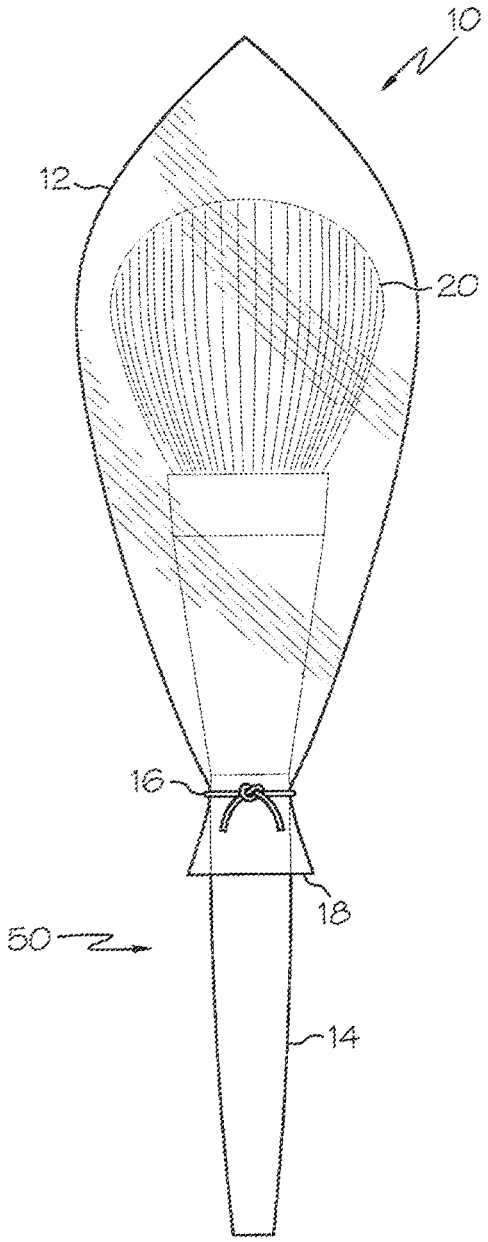
FIG. 1 depicts a top view of a version of a protective brush cover with a makeup brush.
Figure 2:
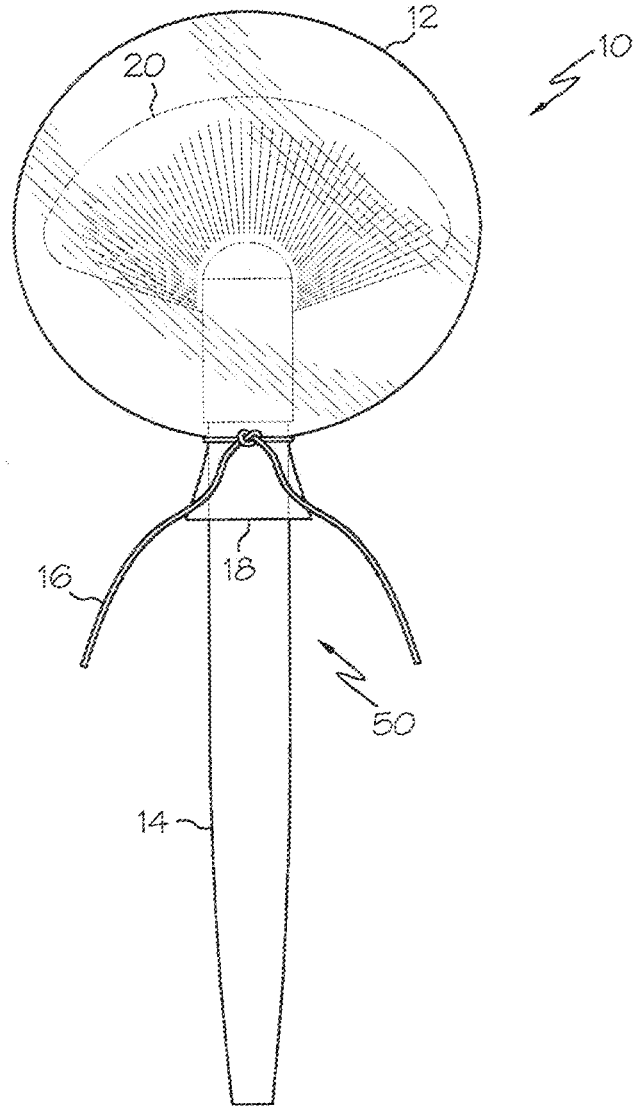
FIG. 2 depicts a top view of an alternative version of a protective brush cover with a makeup brush.

In FIG. 1, a version of a protective brush cover 10 is shown. The protective brush cover 10 may generally comprise a pouch 12, an opening 18, and a tying feature 16. Protective brush cover 10 may be used with a makeup brush 50 having bristles 20 and a shaft 14.

Pouch 12 and opening 18 may be configured to receive bristles 20 of makeup brush 50. The shape of pouch 12 may be generally round. In other versions, the shape of pouch 12 may be cone shaped, cylindrical shaped, triangle shaped, rectangle shaped, square shaped, or any other suitable shape for receiving makeup brush 50 so as to minimize compressing bristles 20 of makeup brush 50.

Figure 3:
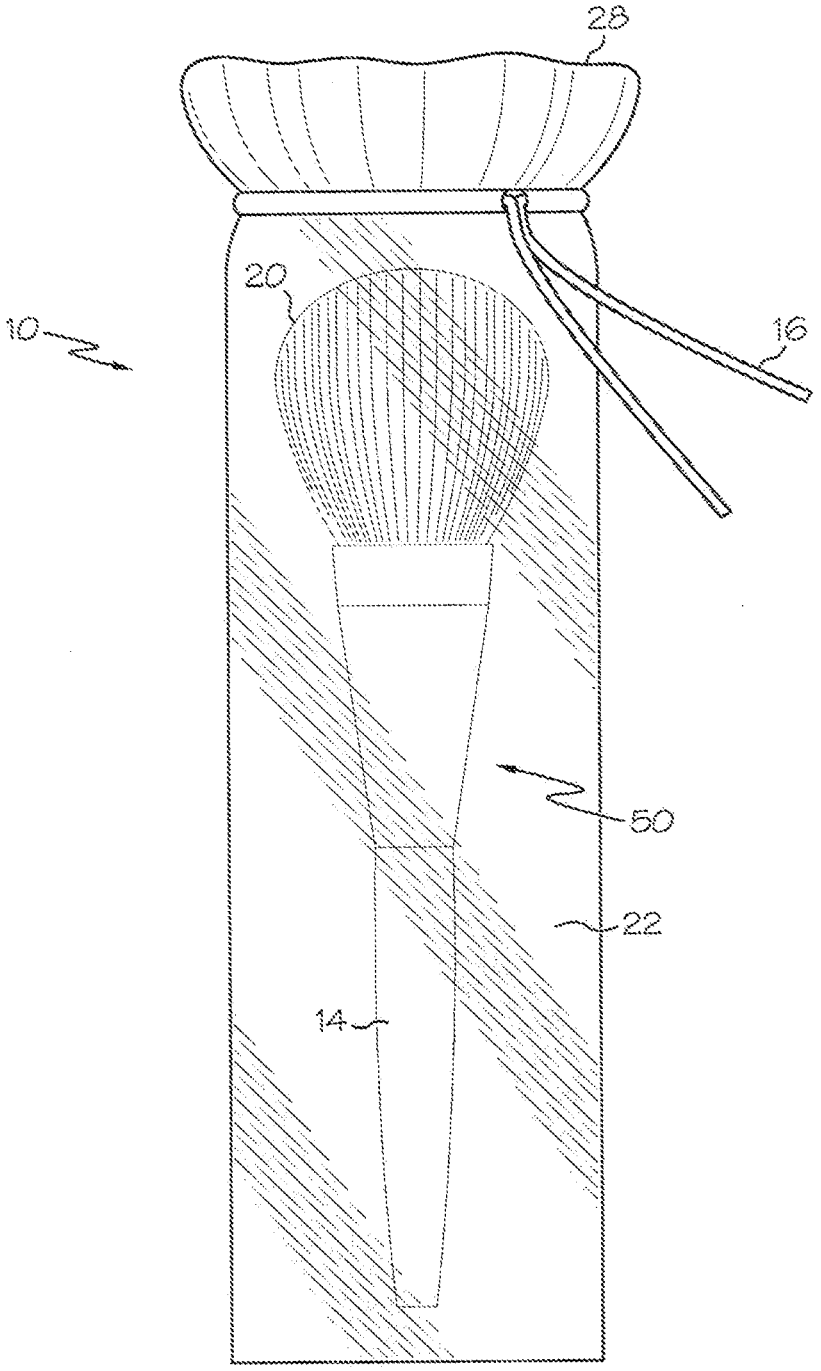
FIG. 3 depicts a top view of another alternative version of a protective brush cover with a makeup brush
Figure 4:
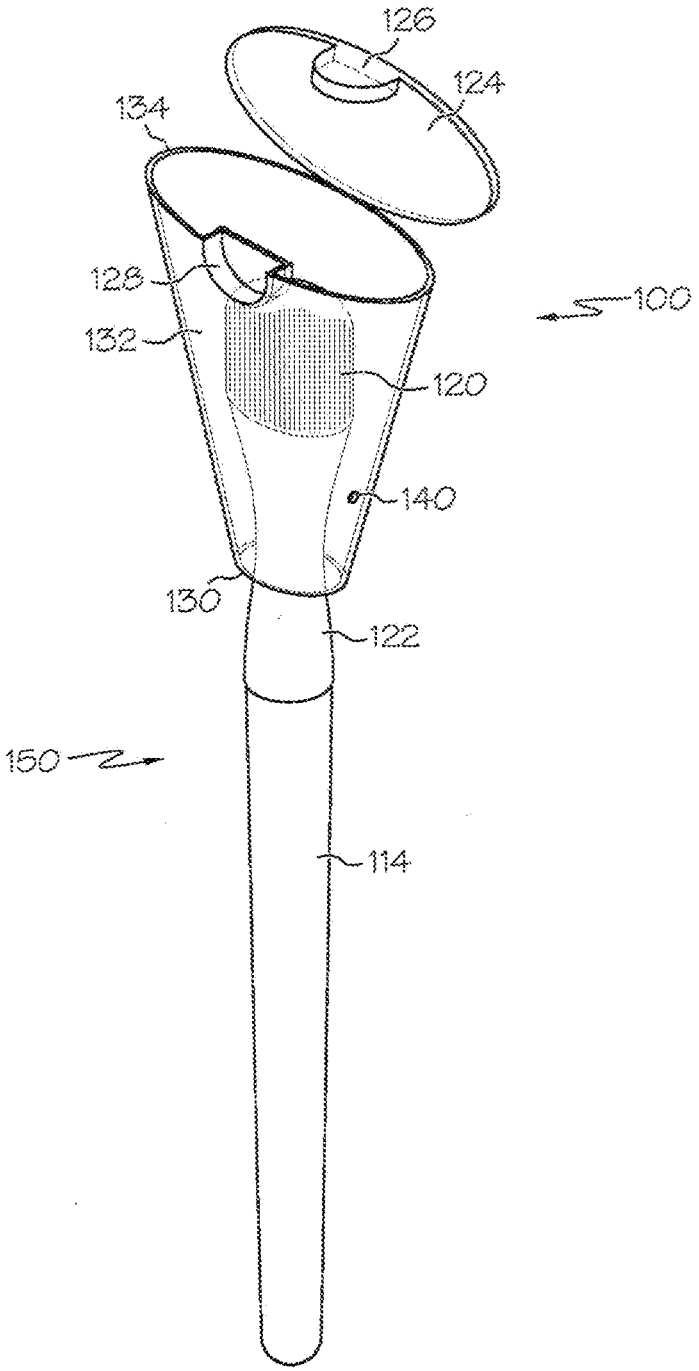
FIG. 4 depicts a perspective view of another alternative version of a protective brush cover with a makeup brush.
Figure 5:
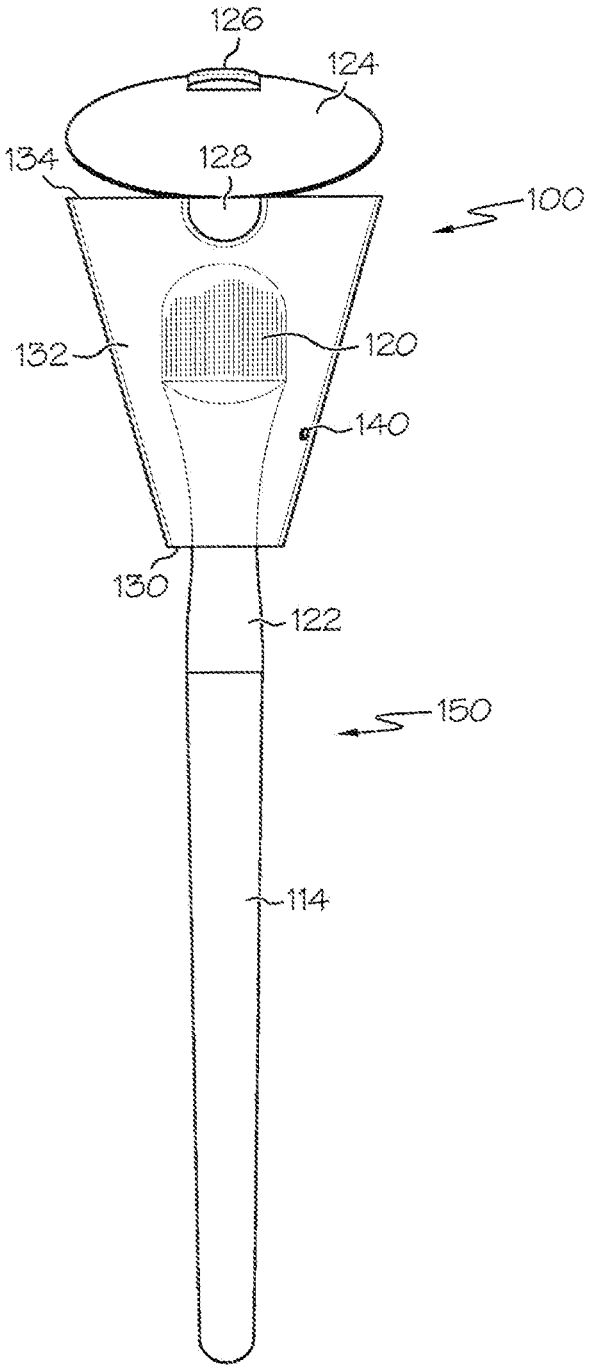
FIG. 5 depicts a front view of the protective brush cover of FIG. 4.
Figure 6:
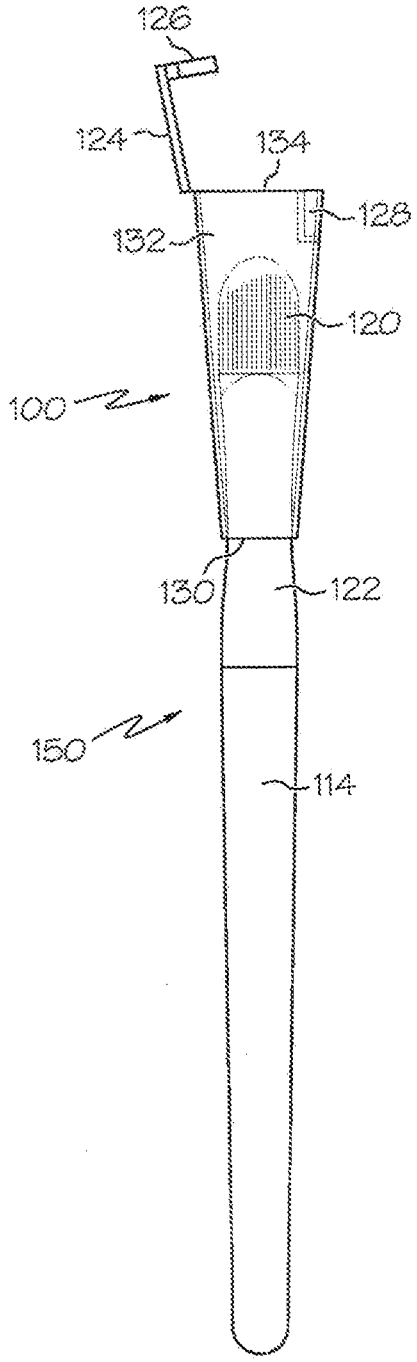
FIG. 6 depicts a side view of the protective brush cover of FIG. 4
Figure 7:
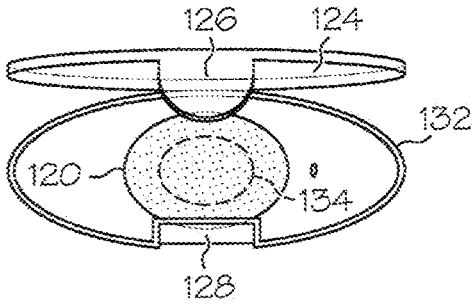
FIG. 7 depicts a top view of the protective brush cover of FIG. 4.

Pouch 12 may be various sizes as well. Pouch 12 may be of a size to cover bristles 20 of makeup brush 50 without substantially covering shaft 14 of makeup brush 50. In an alternative version, as shown in FIG. 3, pouch 22 may be of a size sufficient to cover the entire makeup brush 50.

Further, pouch 12 may be of a size and shape to protect bristles 20 of makeup brush 50 while minimizing the overall size of makeup brush 50 and protective brush cover 10 to reduce obtrusiveness in a purse or bag. Pouch 12 may be of a size and shape specifically designed to enclose a particular make and model makeup brush 50. Other suitable shapes and sizes of pouch 12 will be apparent to those of ordinary skill in the art in view of the teachings herein.

The material of pouch 12 may be a soft fabric material. Furthermore, the material of pouch 12 may be rigid or stiff. A flexibly rigid material may be used to allow pouch 12 to maintain shape when placed in a purse or other bag to protect bristles 20 of makeup brush 50. The material of pouch 12 may be selected from any suitable material including, but not limited to, cotton, nylon, polyester, denim, satin, wool, leather, cashmere, linen, felt, silk, velvet, organza, plastic, and vinyl. The material of pouch 12 may also be washable so that pouch 12 may be washed after multiple uses to remove makeup and other dirt from pouch 12. Further, the material of pouch 12 may comprise an antibacterial material.

Pouch 12 may comprise various colors and patterns. Suitable colors and patterns may be selected so that when placed in a purse or other bag, protective brush cover 10 is highly visible to allow quick retrieval. Suitable colors and patterns may be selected for other aesthetic reasons. Other suitable colors and patterns of pouch 12 will be apparent to those of ordinary skill in the art in view of the teachings herein.

The opening 18 of pouch 12 of protective brush cover 10, in versions where the make-up brush is inserted through a bottom opening 18 of the pouch 12, may be of a size suitable to allow the bristle end of a makeup brush to enter. Opening 18 of pouch 12 may be opened and closed through use of a tying feature 16. By manipulating tying feature 16, opening 18 of pouch 12 may have two positions: an open position and a tightened position. In the open position, opening 18 of pouch 12 may be sufficiently large enough to allow bristle 20 end of makeup brush 50 to be easily placed into or removed from pouch 12 of protective brush cover 10.

In the tightened position, opening 18 of pouch 12 may substantially tighten or snuggly tighten around shaft 14 of protective brush cover 10. The tightened position may be sufficiently tight so as to prevent unintentional removal of makeup brush 50 from protective brush cover 10. The tightened position may also be sufficiently tight so that protective brush cover 10 stays on makeup brush 50 when makeup brush 50 is placed inside a purse or other bag. Other suitable sizes of opening 18 of pouch 12 will be apparent to those of ordinary skill in the art in view of the teachings herein.

Tying feature 16 may be configured to work with opening 18 of pouch 12 of protective brush cover 10 to change the size of opening 18. The tying feature 16 may comprise at least one drawstring that may be pulled or loosened to change the size of the opening 18. Tying feature 16 may further comprise a single drawstring or may comprise a plurality of drawstrings. Upon changing the size of opening 18, the drawstring or plurality of draw strings may be wrapped around protective brush cover 10 or may be allowed to freely hang. An additional tightening feature (not shown), such as, for example, a bead may be used to maintain the open or the tightened position of tying feature 16. Other suitable methods or configurations to tighten or loosen opening 18 of pouch 12 may be used as well. For example, tying feature 16 may comprise, but is not limited to, one or more clasps, rubber bands, flexible wires, ribbon, etc., suitable to manipulate the size or shape of opening 18 of pouch 12 of protective brush cover 10.

In one version, the user may use protective brush cover 10 by placing the brush through opening 18 of protective brush cover 10 and into pouch 12. Then the user may engage tying feature 16 to tighten opening 18 of protective brush cover 10. The user may then place protective brush cover 10 in the user's purse or other bag for storage or transport. In an alternative version, the user may place makeup brush 50 in protective brush cover 10 and may place the covered makeup brush 50 in a purse, a makeup bag, or other bag without manipulating tying feature 16.

The user may then transport or store the covered makeup brush 50 in the purse or other bag. The user may remove the covered makeup brush 50 from the purse or other bag. The user may remove makeup brush 50 from protective brush cover 10 by loosening tying feature 16 or by simply removing the brush from protective brush cover 10 without manipulating tying feature 16.

FIGS. 4-9 depict another version of a protective brush cover 100 for use with a makeup brush 150. Makeup brush 150 comprises a handle 114 and a head 120. Protective brush cover 100 comprises a body 132 and a lid 124. Body 132 is shaped to have a slightly flattened frustoconical shape with a mouth 134 and a neck opening 130. Neck opening 130 is sized wide enough such that handle 114 of makeup brush 150 may be inserted through neck opening 130 yet narrow enough that head 120 of makeup brush 150 does not slip through neck opening 130. The contours of body 132 may be sufficiently wide such that the walls do not compress or damage the bristles of head 120, yet narrow enough such that protective brush cover 100 and makeup brush 150 can be easily placed into, for example, a purse. The degree of flatness of body 132 may be shaped such that it generally tracks the contours of head 120 of makeup brush 150. For example, if makeup brush 150 is very wide or if the bristles of makeup brush 150 flare widely, body 132 may be shaped to accommodate such flare. Body 132 comprises a generally rigid material such as a cardboard or plastic. However any suitable material may be used.

Near mouth 134 of body 132, a semicircular recess 128 is formed. Recess 128 is shaped to complement the magnetic tab 126 attached to lid 124. Recess 128 may comprise a magnet or other magnetically influenced material or metal embedded beneath the surface of the recess such that when lid 124 shuts upon body 132, recess 128 and tab 126 magnetically lock together to keep lid 124 closed. The force of the magnetic bond formed between recess 128 and tab 126 may generally be strong enough such that lid 124 is not inadvertently opened, for example, during transport, but weak enough such that a user may easily open lid 124 by decoupling magnetic bind between recess 128 and tab 126. While recess 128 and tab 126 comprise a complementary semi circular shape, any suitable shape for recess 128 and tab 126 may be used as would be apparent to one of ordinary skill in the art in view of the teachings herein. Furthermore, a vent hole 140 is positioned on body 132 to provide ventilation within protective brush cover 100 while makeup brush 150 is placed in protective brush cover 100 with lid 124 closed.

Figure 8:
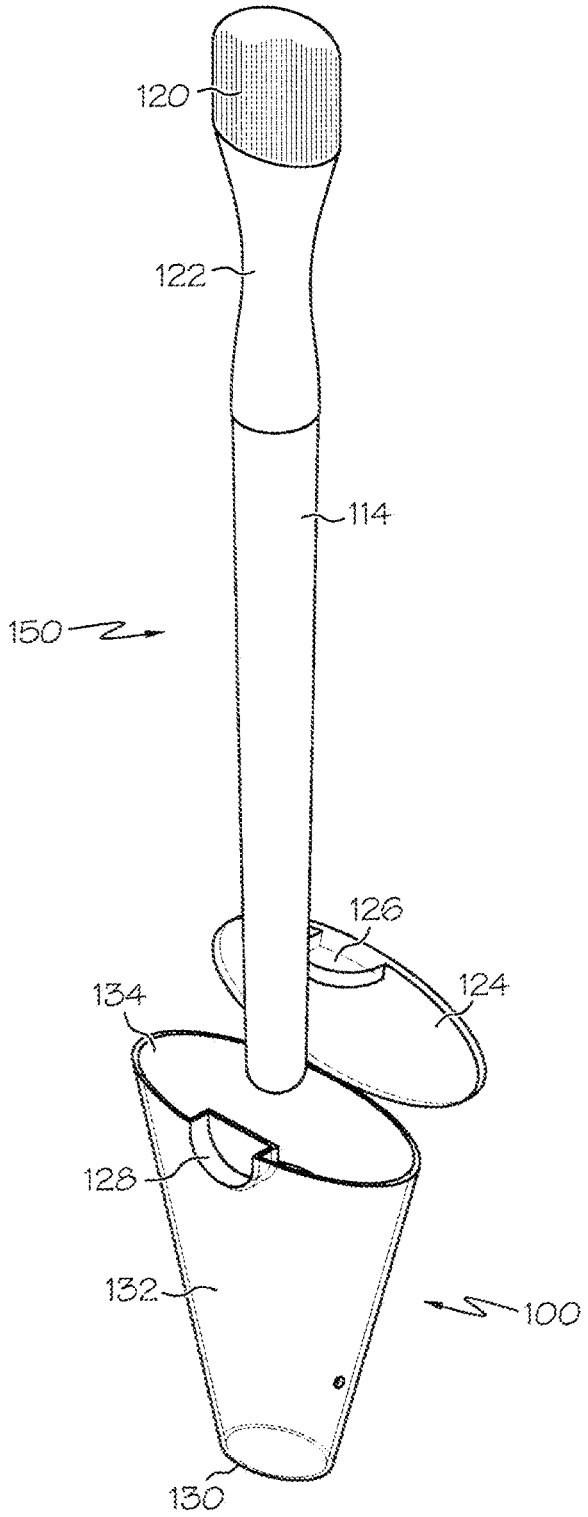
FIG. 8 depicts a perspective view of the protective brush cover of FIG. 4 with the makeup brush removed.
Figure 9:
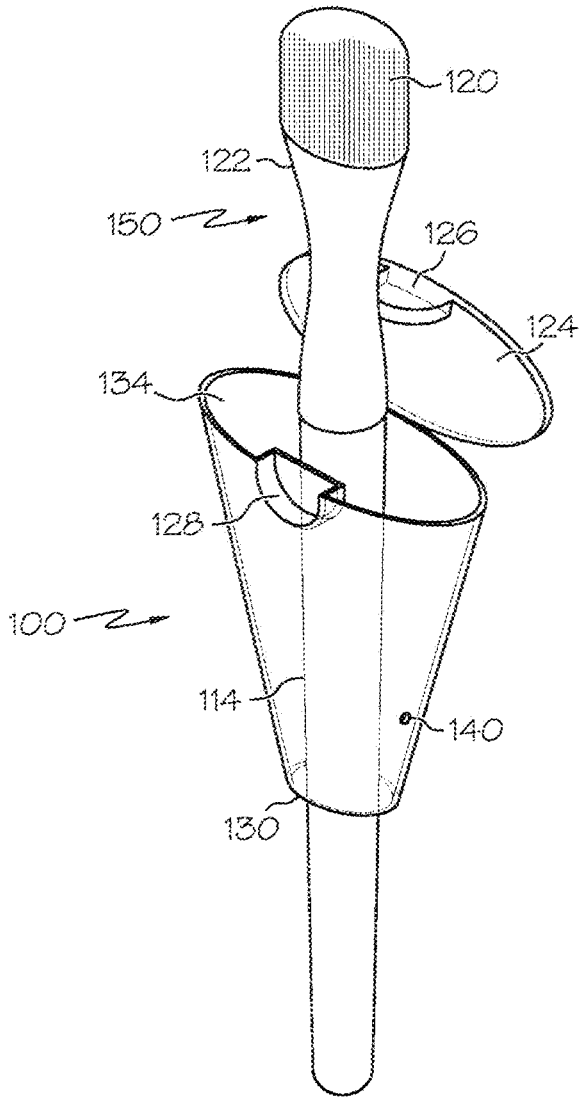
FIG. 9 depicts a perspective view of the protective brush cover of FIG. 4 with the makeup brush being inserted into the protective brush cover.
Figure 10:
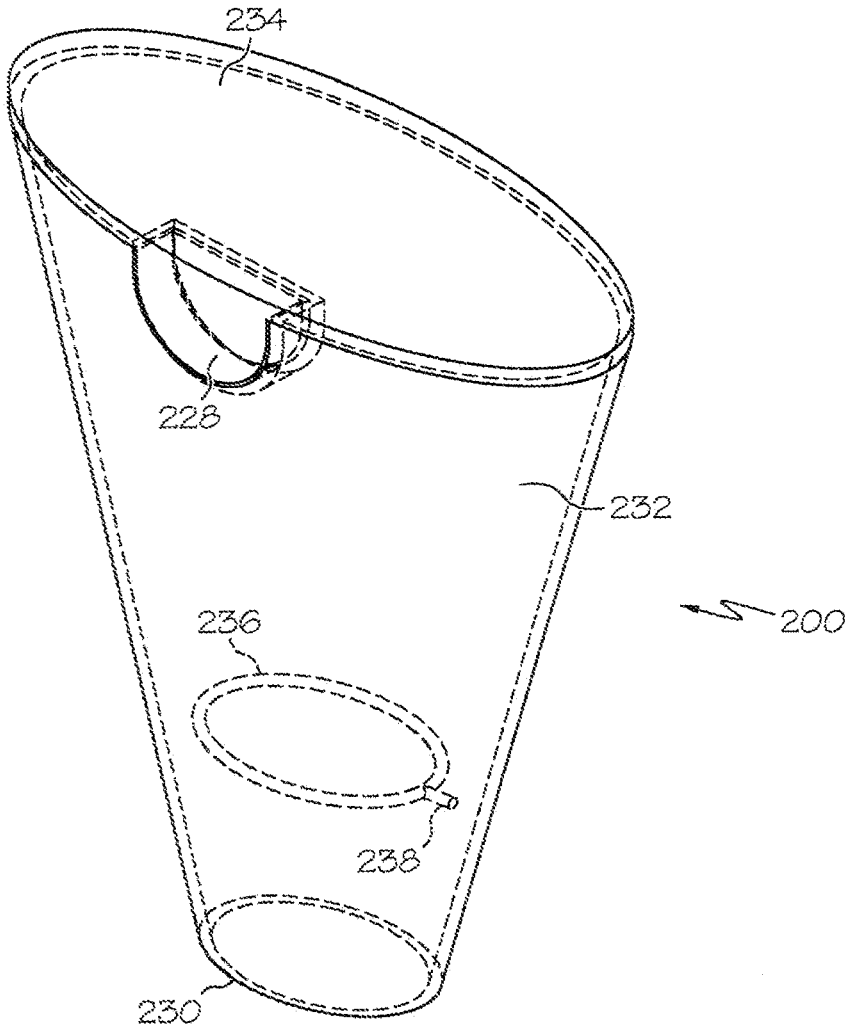
FIG. 10 depicts a perspective view of an alternative version of a protective brush cover.
Figure 11:
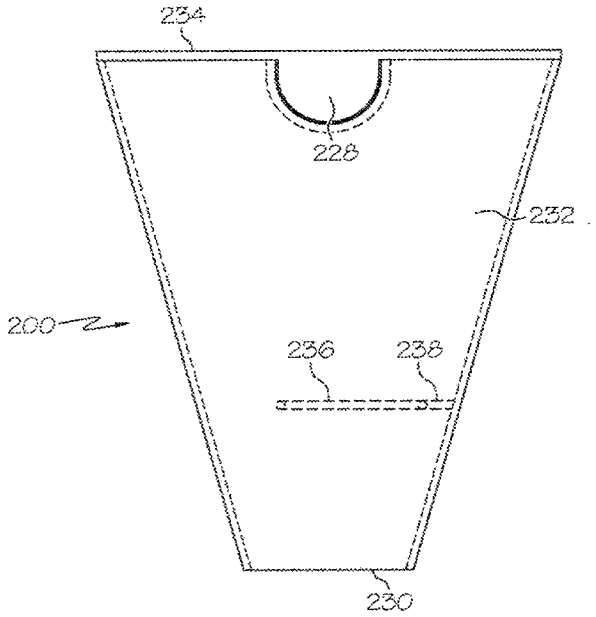
FIG. 11 depicts a front view of the protective brush cover of FIG. 10.
Figure 12:
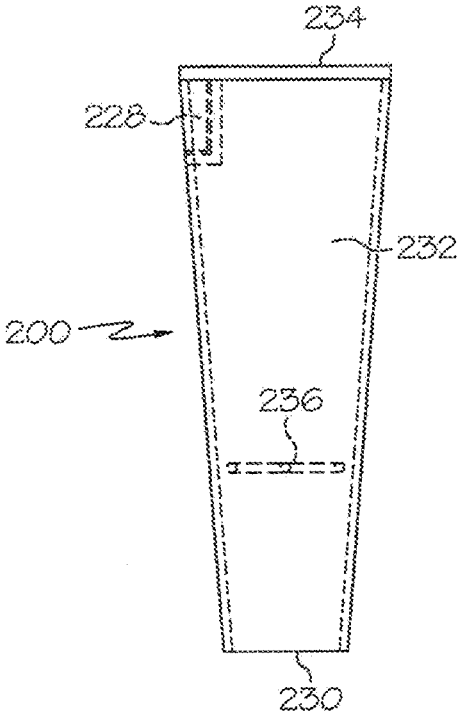
FIG. 12 depicts a side view of the protective brush cover of FIG. 10.
Figure 13:
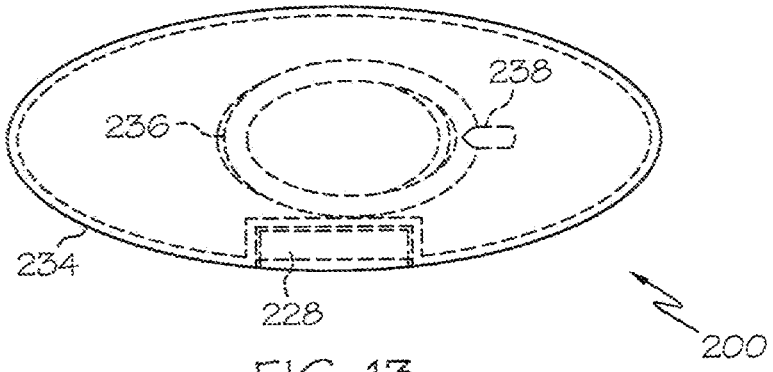
FIG. 13 depicts a top view of the protective brush cover of FIG. 10

Generally, protective brush cover 100 may be used as shown in FIGS. 8-9. Lid 124 of protective brush cover 100 is opened and makeup brush 150 is inserted through mouth 134 of protective brush cover 100. Handle 114 of makeup brush 150 travels through neck opening 130. The taper of the portion near neck opening 130 of protective brush cover 100 aids in preventing makeup brush 150 from sliding completely through neck opening 130. Furthermore the taper of neck opening 130 enables a user to simply drop makeup brush 150 into protective brush cover 100 since the taper helps guide makeup brush 150 through neck opening. Additionally, as mentioned above, neck opening 130 may be sufficiently narrow so as to form a grip around a neck portion 122 of makeup brush 150.

Once makeup brush 150 is inserted into protective brush cover 100 such that head 120 is enclosed, the user can close lid 124 of protective brush cover 100 for transport or storage of makeup brush 150.

FIGS. 10-13 depict an alternative version of a protective brush cover 200 that is substantially similar to protective brush cover 200 shown in FIGS. 4-9 where the protective brush cover 200 comprises a body 232, mouth 234, neck opening 230, and recess 228. In the illustrated version, protective brush cover 200 comprises an interior loop 236 with a connecting portion 238 to attach interior loop 236 to body 232 of protective brush cover 200. Interior loop 236 comprises generally a wire loop able to grip the neck of a makeup brush, such as the makeup brush shown in FIGS. 4-9. It will be appreciated that interior loop 236 may provide additional stability in securing a makeup brush.

Figure 14:
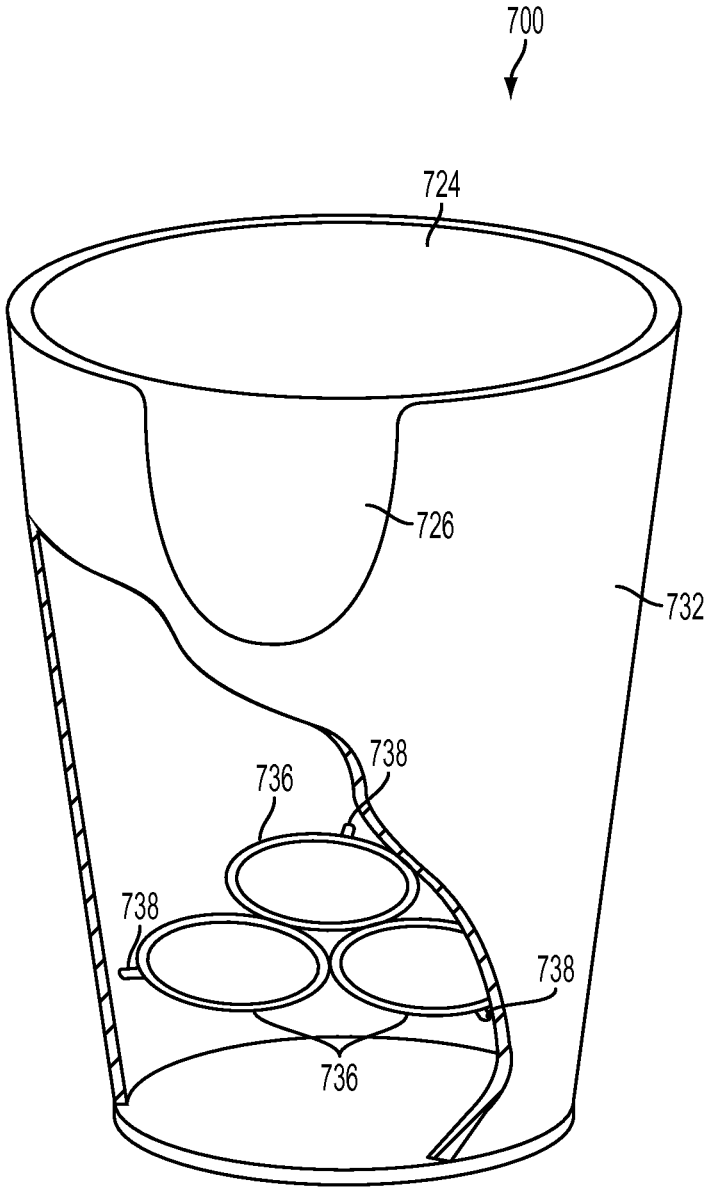
FIG. 14 depicts a perspective partial cutaway view of a brush cover.

While FIGS. 10-13 show a brush cover having one interior loop 236, other embodiments may utilize a plurality of interior loops or other suitable internal retention devices. FIG. 14 shows a perspective partial cutaway view of a brush cover 700 having example internal retention devices. The brush cover 700 comprises a body 732, a lid 724, a tab 726, and plurality of interior loops 736. The interior loops 736 may be attached to the body 732 with a connecting portion 738, or any other suitable attachment technique. Each of the interior loops 736 can receive the handle of a makeup brush. While the brush cover 700 depicted has three interior loops, other embodiments may have a different number of interior loops.

Figure 15:
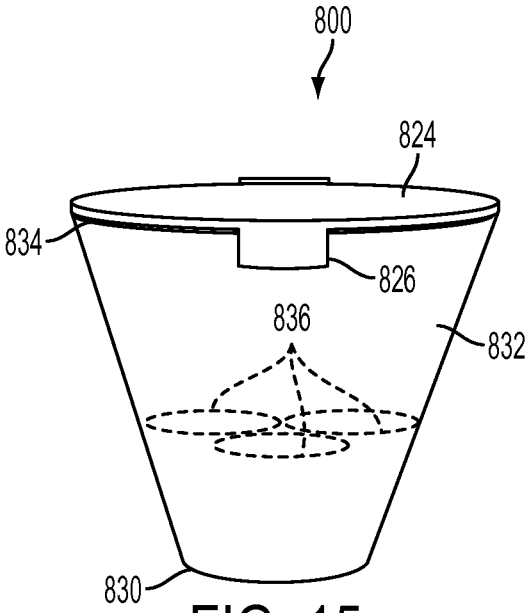
FIG. 15 depicts a perspective view of a brush cover.
Figure 16:
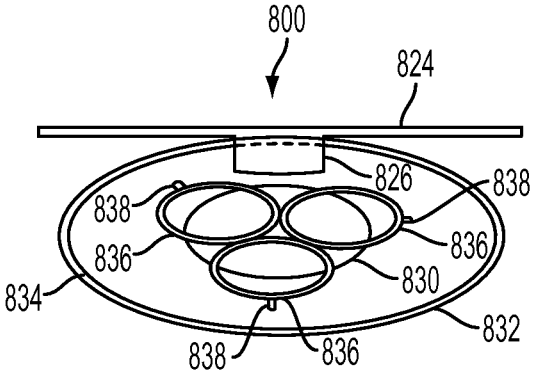
FIG. 16 depicts a top view of the brush cover of FIG. 15.
Figure 17:
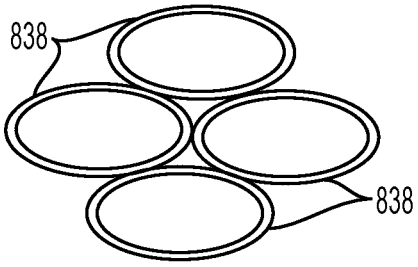
FIG. 17-18 depict example arrangements of interior loops.
Figure 18:
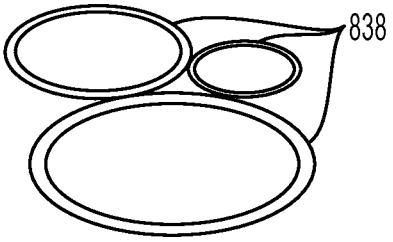

FIGS. 15-16 depict another version of a brush cover 800 having interior loops 838. FIG. 15 is a perspective view of the brush cover 800 and FIG. 16 is a top view of the brush cover 800 with the lid 824 moved to the open position. The interior loops 838 are horizontally arranged and positioned in-between the first opening 830 and the second opening 834. In some embodiments, the interior loops 838 are attached to the body 832 using a connecting portion 838. The interior loops may be positioned within the brush cover 800 such that they are closer to the first opening 830 than the second opening 834. In other embodiments, the interior loops may be positioned such that they are generally aligned with the first opening 830. The interior loops 838 can be any suitable shape, such as generally circular, oblong, or multi-sided, for example. Additionally, the interior loops 838 can be flexible, rigid, and/or elastic, for example. The interior loops 838 can be made from any suitable material or combination of materials, such as textiles, elastics, rubbers, plastics and/or metals, for example. Furthermore, any suitable number of loops, each having any suitable size may be used. By way of example, FIG. 17 depicts an arrangement of four interior loops 838 that can be used with various brush covers and FIG. 18 depicts an arrangement of three interior loops 838 that are each a different size. The arrangement shown in FIG. 18 may be used with brush covers that are intended to simultaneously store a plurality of different sized makeup brushes, for example. The quantity of makeup brushes storable in any particular brush cover may vary based on, for example, the size of the brush cover, the size of the makeup brushes to be stored, and the arrangement of any interior loops.

Figure 19:
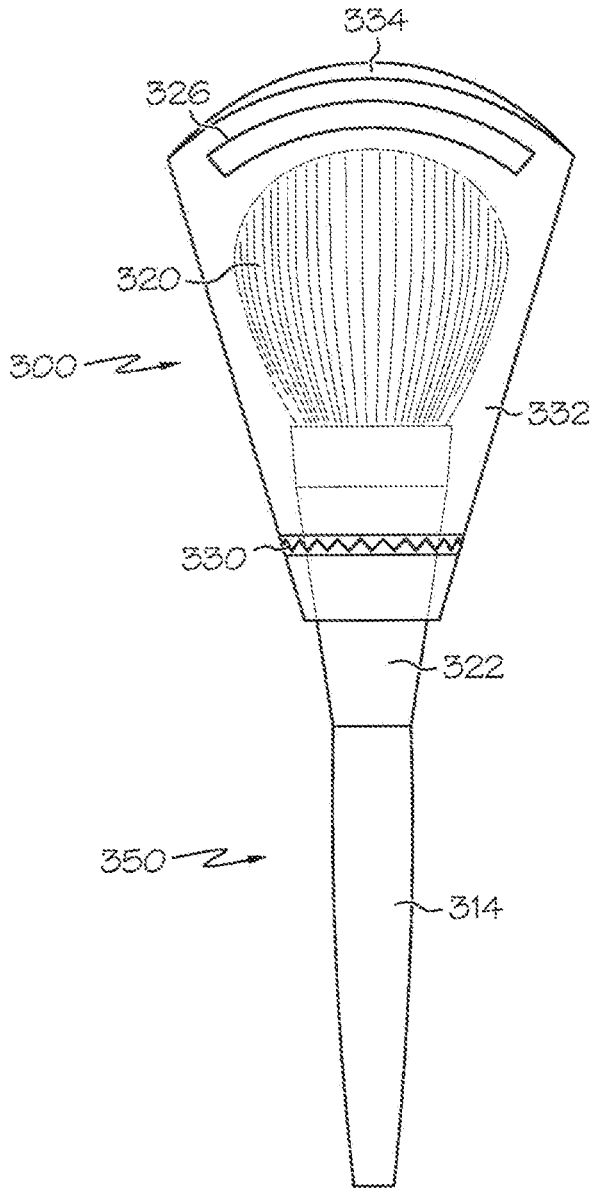
FIG. 19 depicts a front view of an alternative version of a protective brush cover having a magnetic enclosure.

FIG. 19 depicts an alternative version of a protective brush cover 300 comprising a body 332, a neck opening 330, a mouth 334 and a magnetic strip 326 for use with a makeup brush 350, which comprises a head 320, a handle 314, and a neck 322. In the illustrated version, body 332 comprises a cloth-like material. Of course, any suitable material may be used.

Magnetic strip 326 has a generally arc-like shape that matches the shape of mouth 334. A second similarly shaped magnetic strip (not shown) is positioned opposite to magnetic strip 326 such that mouth 334 may be held shut once a makeup brush 350 is placed though 334 of protective brush cover 300 by joining magnetic strip 326 with the second magnetic strip. While in this version, magnetic strip 326 and the second magnetic strip are similarly shaped, they may have different shapes, such as, for example, complementary shapes or interlocking shapes.

Neck opening 330 comprises gathered fabric material having an elastic band, rope, thread, drawstring, or liner extending circumferentially around neck opening 330 such that neck opening 330 may be opened and then tightened around a neck 322 of a makeup brush 350 once a handle 314 of makeup brush 350 is placed through neck opening 330. The tightness of neck opening 330 is sufficient such that makeup brush 350 should not slip out of neck opening 330, yet not so tight that makeup brush 350 cannot be intentionally removed from protective brush cover 300.

Figure 20:
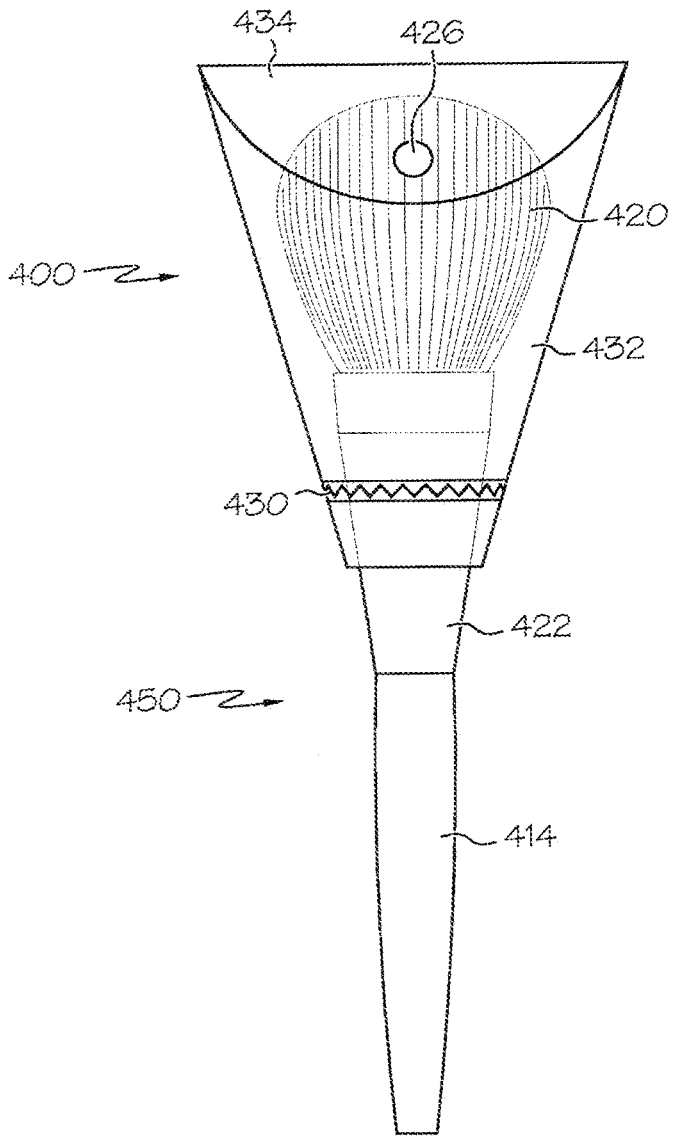
FIG. 20 depicts a front view of an alternative version of a protective brush cover having a snap fit enclosure.

FIG. 20 depicts an alternative version of a protective brush cover 400 comprising a body 432, a neck opening 430, a flap 434, and a fastener 426 for use with a makeup brush 450 having a handle 414, a neck 422 and a head 420. Flap 434 is designed to cover the mouth (not shown) of protective brush cover 400. In the illustrated version, fastener 426 comprises a snap button fit, but any suitable fastening means may be used, such as, for example, a clasp, hook, or pin.

Figure 21:
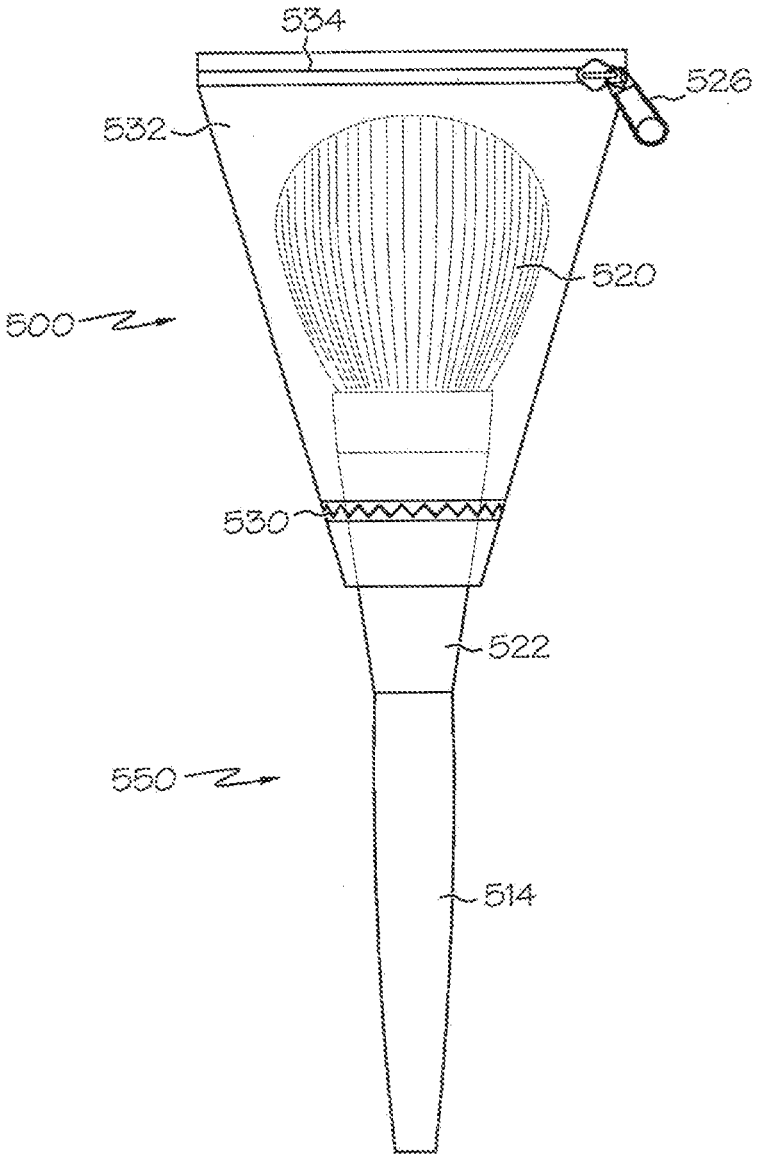
FIG. 21 depicts a front view of an alternative version of a protective brush cover having a zipper enclosure.

FIG. 21 depicts an alternative version of a protective brush cover 500 comprising a body 532, a neck opening 530, a zipper opening 534, and a zipper pull 526. Zipper pull 526 may be manipulated by a user to open and close zipper opening 534 of protective brush cover such that a makeup brush 550 having a head 520, neck 522 and handle 514 may be inserted or removed through zipper opening 534. In one version, the neck opening may remain closed where, for example, when the zipper pull 526 is actuated only a side portion of the brush cover 500 is unzipped. In this version, the handle 514 may be inserted through the neck opening, the brush 520 may be positioned within the brush cover 500, and the zipper pull 526 may then be actuated to close the brush cover 500.

Figure 22:
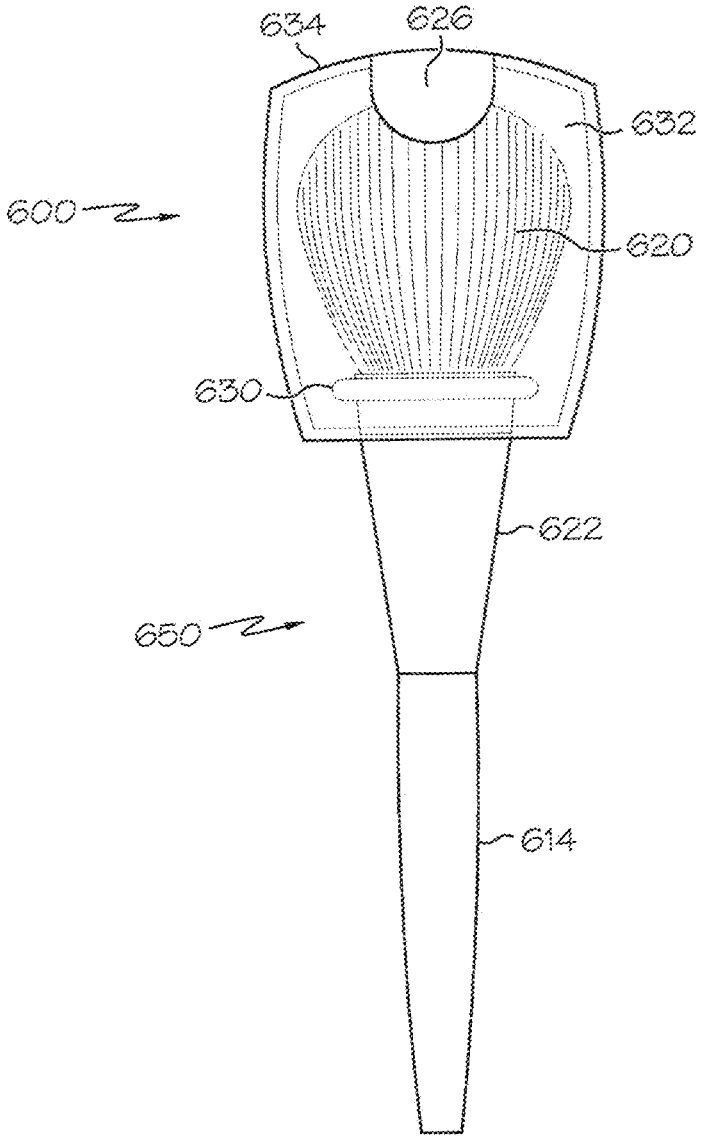
FIG. 22 depicts a front view of an alternative version of a protective brush cover having a magnetic snap lid.

FIG. 22 depicts an alternative version of a protective brush cover 600 comprising a body 632, a magnetic flap 626, and an embedded band 630 for use with a makeup brush 650 having a head 620, a neck 622, and a handle 614.

Embedded band 630 may be sized to fit a variety of different brush sizes. For example, for larger brushes, embedded band 630 may be wider or longer. Accordingly, a shorter or narrower embedded band 630 may be used for smaller brushes. Also, the illustrated version comprises a generally square-like shaped protective brush cover 600. It will be appreciated that as the length or width of embedded band 630 is selected for the appropriate size makeup brush 650, the dimensions or general shape of protective brush cover 600 may be adjusted to accommodate embedded band 630.

Magnetic flap 626 comprises a flap having a magnet embedded in the flap. Magnetic flap 626 may join with an associated element embedded in body 632 of protective brush cover 600 to close protective brush cover 600 once makeup brush 650 has been inserted.

Figure 23:
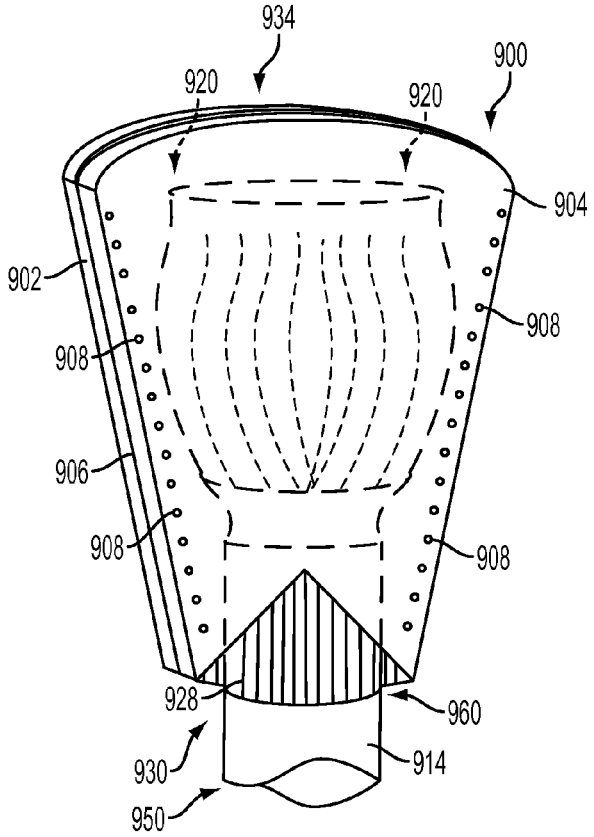
FIG. 23 depicts a perspective view of a brush cover that is housing a head of a makeup brush.

FIGS. 23-27 depict an example embodiment of a brush cover 900 comprising a first panel 902 and a second panel 904. FIG. 23 depicts a perspective view of the brush cover 900 housing a head 920 of a makeup brush 950. FIG. 24A depicts a side elevational view of the first panel 902 and FIG. 24B depicts a side elevational view of the second panel 904. FIG. 24C depicts a cross-sectional view of the brush cover of FIG. 24B taken along line 24C-24C.

In some embodiments, the first panel 902 and the second panel 904 may be a single unitary panel. For example, the unitary panel may be folded to form the first panel 902 and the second panel 904. Additionally, either or both of the first and second panels 902, 904 can be rigid, flexible, or a combination of rigid and flexible portions. In some embodiments, the first and second panels 902, 904, or at least portions of the panels, are a textile, such as cloth-like material. In some embodiments, the first and second panels 902, 904, or at least portions of the panels, are leather or a leather-like material. In some embodiments, the first and second panels 902, 904, or at least portions of the panels, are a plastic or rigid material. As with many of the embodiments described herein, one of more of the panels 902, 904 may also comprise a liner, such as a nylon or plastic liner.

The first and second panels 902, 904 may be coupled together near their outer edge to form a seam 906. In FIG. 23, panel stitching 908 is shown that attaches the first panel 902 to the second panel 904. As is to be appreciated, however, any suitable coupling or bonding technique may be used, such as, for example, ultrasonic welding, gluing, riveting, and so forth. Furthermore, while the panel stitching 908 is shown extending substantially along the entire length of the outer edge, a shorter length of stitching (or other connection technique) may be used to achieve the desired performance of the brush cover 900. For example, in some embodiments, about half of the length of the seam 906 is connected using panel stitching 908.

Figure 24A:
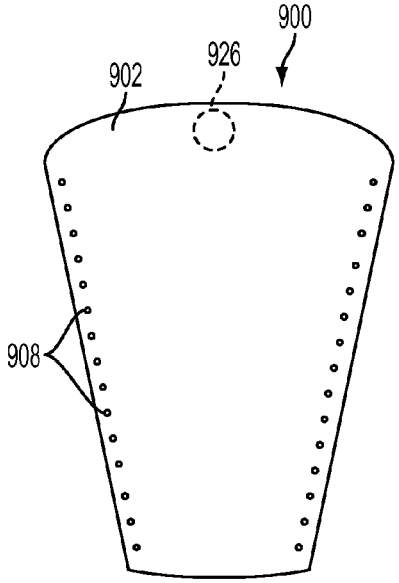
Figure 24B:
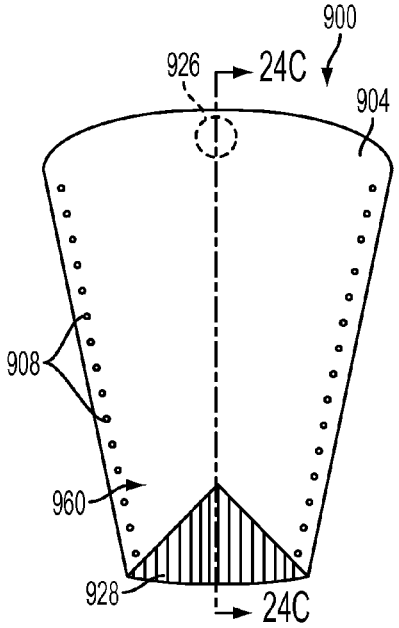
Figure 24C:
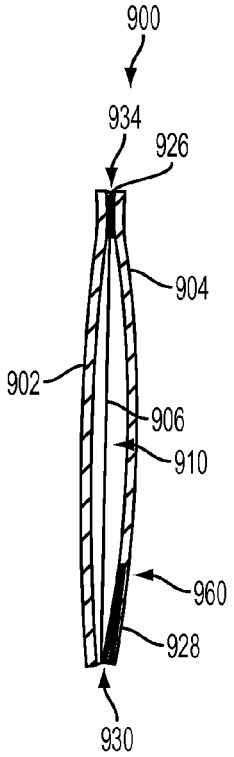
FIG. 24C depicts a cross-sectional view of the brush cover of FIG. 24B taken along line 24C-24C.

The first and second panels 902, 904 may cooperatively define an expandable pocket 910 (FIG. 24C). The pocket 910 may be sized to accommodate the head of a makeup brush. The brush cover 900 may define a first opening 930 and a second opening 934, each of which are in communication with the pocket 910. In some embodiments, the second opening 934 is selectably sealable or at least closable. For example, a fastener 926 (FIG. 24A) may be positioned proximate to the second opening to maintain the second opening 934 in a closed position when the fastener 926 is in an engaged position. The fastener 926 may be any suitable fastening, latching, or closing device, such as a magnetic fastener, a snap, a button, a hook-and-loop fastener, a zipper, a zip-lock type fastener, snap button, clasp, latch, hook, pin, and so forth.

The brush cover 900 may also have a retention portion 960. The retention portion 960 may be incorporated into the brush cover 900 at any suitable position, such as proximate the first opening 930, for example. The retention portion 960 may be configured to exert a biasing force to maintain the position of makeup brush that is positioned within the brush cover 900. The retention portion 960 may comprise a biasing feature, such as an elastic member 928. The elastic member 928 may be any suitable shape or configuration. The elastic member 928 illustrated in brush cover 900 is a generally triangular shape, although the present disclosure is not so limited.

Figure 25A:
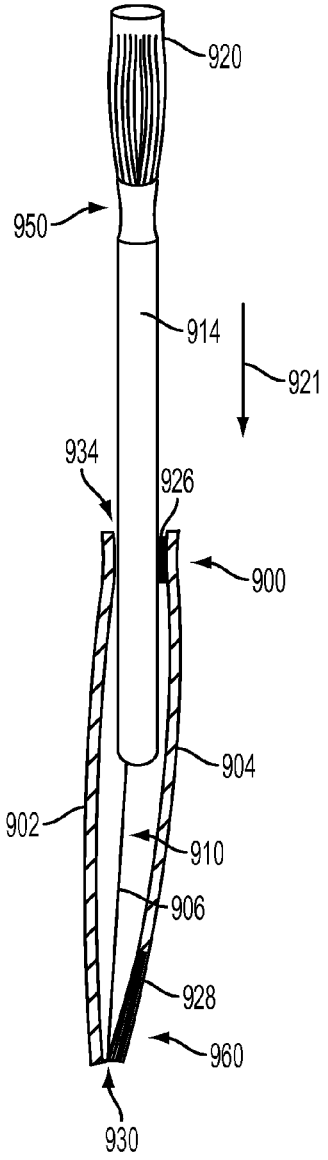
Figure 25B:
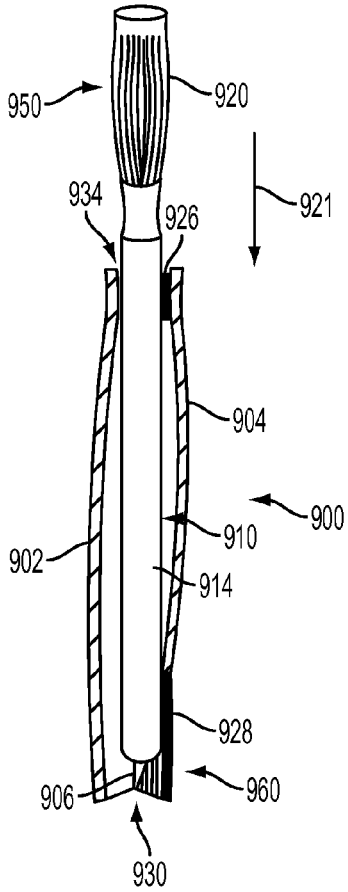
Figure 25C:
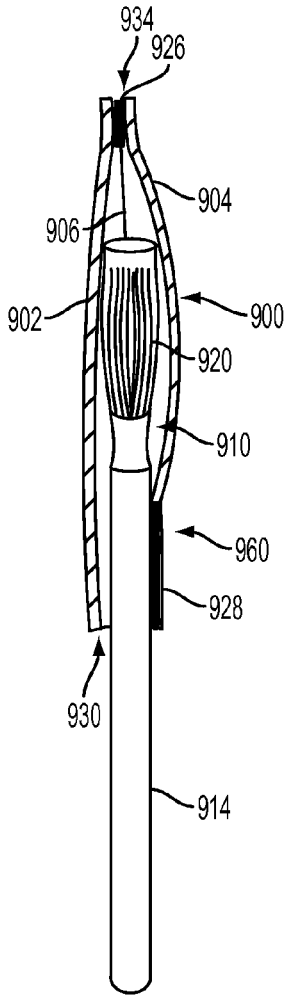

FIGS. 25A-25C show the progression of an example makeup brush 950 being inserted into the expandable pocket 910 of the brush cover 900. As shown in FIG. 25A, the second opening 934 is first opened by disengaging the fastener 926. The handle 914 of the makeup brush 950 is then moved in the direction indicated by arrow 921 and the handle 914 is first inserted into the pocket 910 through the second opening 934. As shown in FIG. 25B, the elastic member 928 outwardly expands when the handle 914 reaches the retention portion 960. The elastic member 928 slides along the handle 914 as the makeup brush is inserted further into the pocket 910 and the handle 914 extends through the first opening 930. As shown in FIG. 25C, when the head 920 of the makeup brush 950 is positioned fully within the pocket 910, the second opening 934 can be closed using fastener 926. With the handle 914 extending through the first opening 930, the elastic member 928 generally exerts a biasing force against the handle 914 to maintain its position relative to the brush cover 900. To remove the makeup brush 950 from the brush cover 900, the makeup brush 950 may be moved in the direction indicated by arrow 921 by pulling the handle 914 through the first opening 930 until the head 920 passes through the first opening 930. The elastic member 928 expands to allow the head 920 to pass through the first opening 930. By pulling the makeup brush 950 through the first opening 930, the chances of fraying the bristles of the head 920 can be reduced. Nevertheless, in some configurations, the process shown in FIGS. 25A-25C can be reversed to remove the makeup brush 950 from the brush cover 900.

Figure 26:
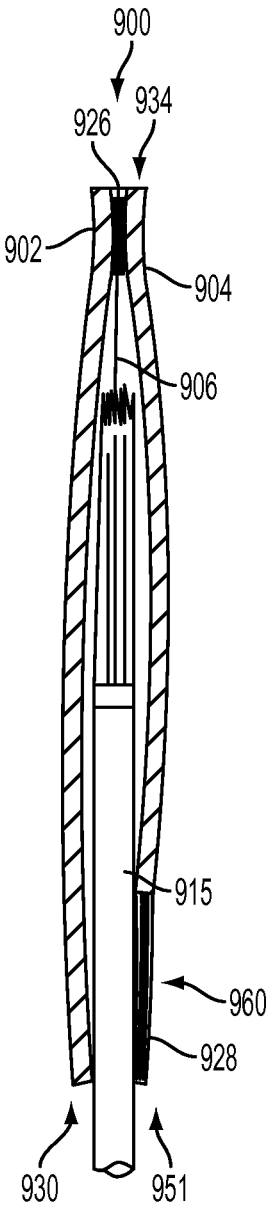
FIGS. 26-27 depict the brush cover of FIG. 23 accommodating different sized brushes.
Figure 27:
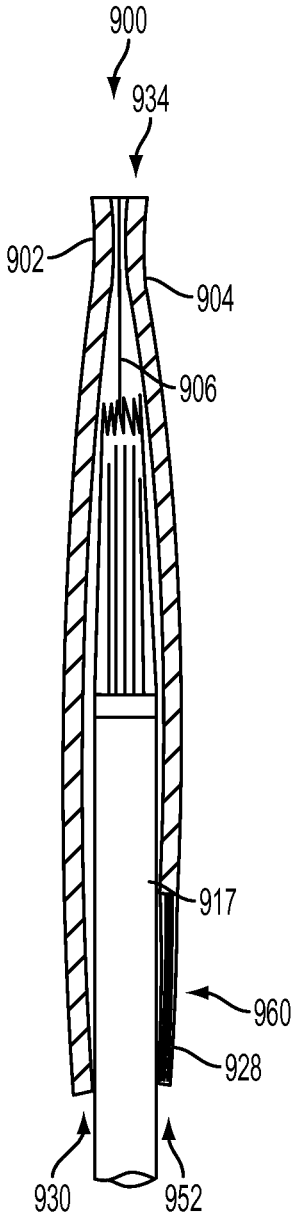

As shown in FIG. 26-27, the brush cover 900 may accommodate a wide variety of brush styles and sizes. In fact, the retention portion 960 may expand and contract as needed based on the size of the makeup brush handle. The handle 915 of the makeup brush 951 shown in FIG. 26 has a smaller diameter than the handle 917 of the makeup brush 952 shown in FIG. 27. As illustrated, the pocket 910 and retention portion 960 of the brush cover 900 expands as necessary to accommodate and adequately retain the makeup brush.

Brush covers in accordance with the present disclosure may have a variety of size, shapes and configurations. FIGS. 28-31 depict front and back views of example brush cover configurations. As is to be appreciated, various components or features of one of the illustrated brush covers may be used in combination with or in place of features from other brush covers. As such, the particular configurations illustrated herein are not intended to be limiting, but instead are used merely to depict example features of elements of example brush covers.

Figure 28:
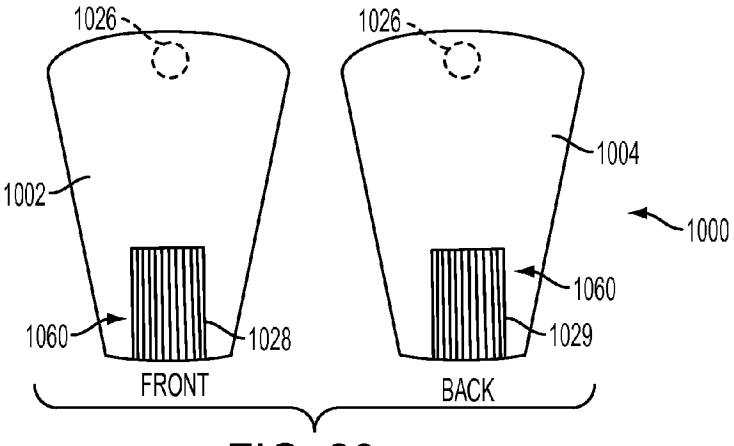

FIG. 28 depicts a brush cover 1000 that has a retention portion 1060. The retention portion 1060 is expandable to accommodate the handle of a makeup brush and helps to maintain the relative position of a makeup brush that is inserted into the brush cover 1000. The retention portion 1060 is comprised of a first elastic member 1028 positioned on a first panel 1002 and a second elastic member 1029 positioned on a second panel 1004. As illustrated, the first elastic member 1028 generally opposes the second elastic member 1029. The brush cover 1000 depicted in FIG. 28 also comprises a fastener 1026.

Figure 29:
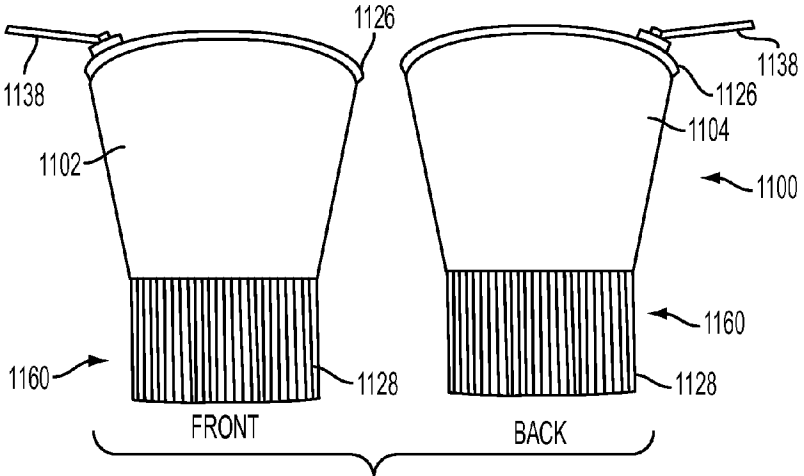
FIGS. 28-31 depict front and back views of example brush cover configurations.

FIG. 29 depicts a brush cover 1100 that has a retention portion 1160. The retention portion 1160 comprises an elastic member 1128. As shown, the elastic member 1128 has a cuff-like structure that is coupled to the first panel 1102 and the second panel 1104. The elastic member 1128 can be any suitable material, such as a textile or a rubber material, for example. A zipper 1126 with a zipper pull 1138 is used to selectively close the brush cover 1100.

Figure 30:
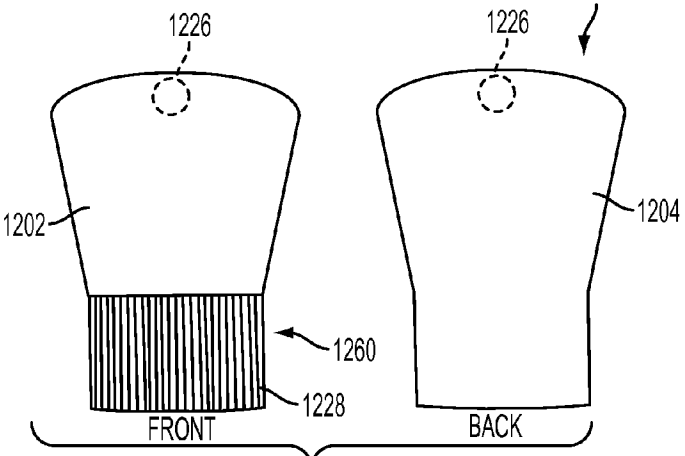

FIG. 30 depicts a brush cover 1200 that has a retention portion 1260. The brush cover 1200 comprises a first panel 1202 and a second panel 1204. The retention portion 1260 comprises an elastic member 1228 which extends across the entire width of the first panel 1202. As shown, the second panel 1204 does not include an elastic member. The brush cover 1200 also comprises a fastener 1226.

Figure 31:
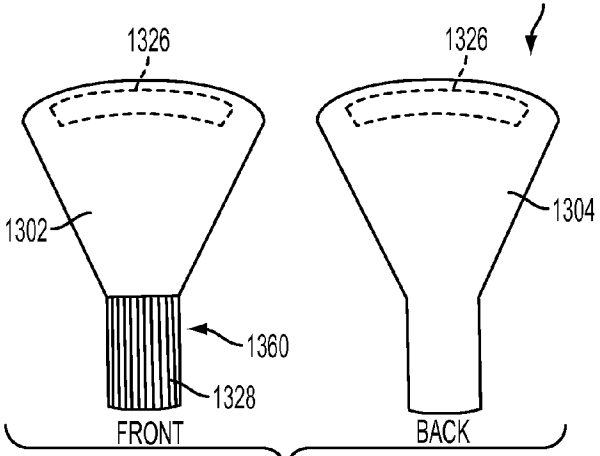

FIG. 31 depicts a brush cover 1300 that has a retention portion 1360 positioned near its bottom. The brush cover 1300 comprises a first panel 1302 and a second panel 1304. The top of the brush cover is substantially larger than the bottom of the brush cover 1300 to create a generally flared shaped. This brush cover 1300 could accommodate, for example, makeup brushes that have relatively large heads and relatively small diameter handles. The retention portion 1360 comprises an elastic member 1328 which extends across the entire width of the first panel 1302. The brush cover 1300 also comprises a fastener 1326. In the illustrated embodiment, the fastener 1326 is a magnetic strip having a generally arc-like shape.

Figure 32C:
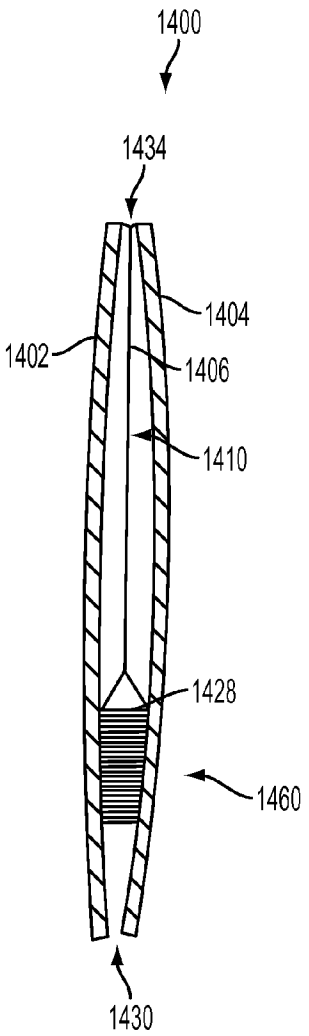
FIG. 32C depicts a cross-sectional view of the brush cover of FIG. 32B taken along line 32B-32B.
Figure 32B:
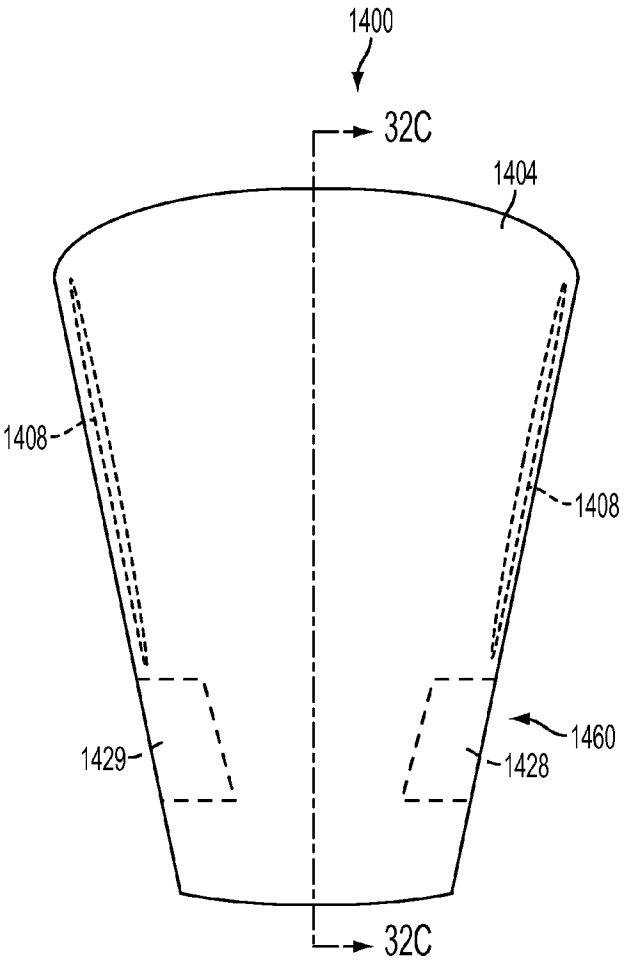
FIGS. 32A-32B depict side elevational views of an example brush cover.
Figure 32A:
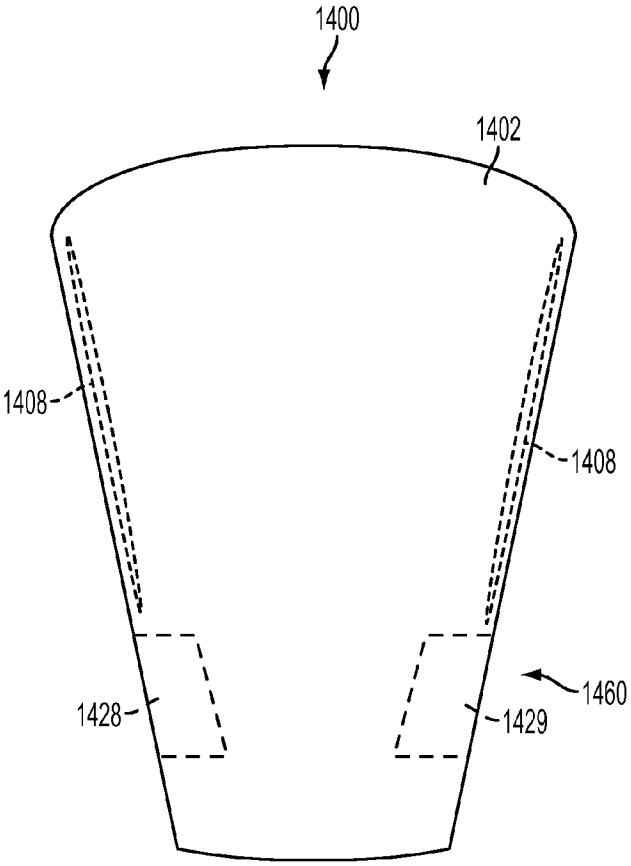
Figure 33:
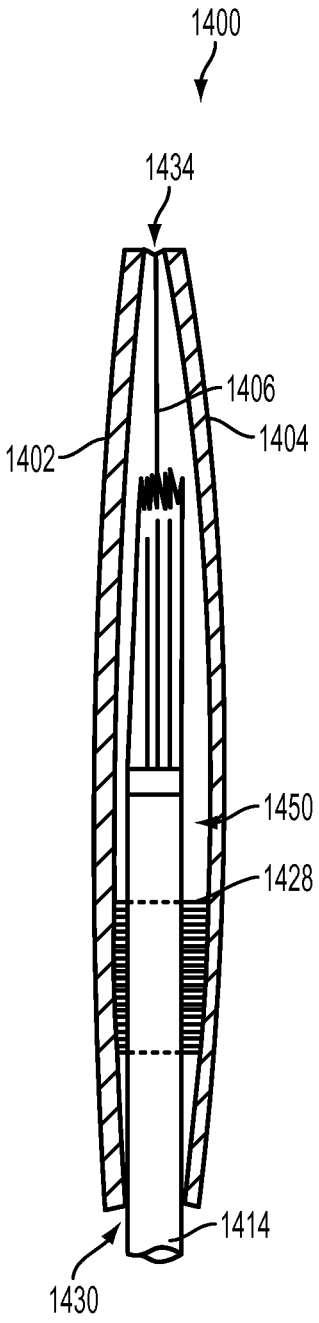
FIGS. 33-34 depict the brush cover of FIGS. 32A-32C accommodating different sized brushes.
Figure 34:
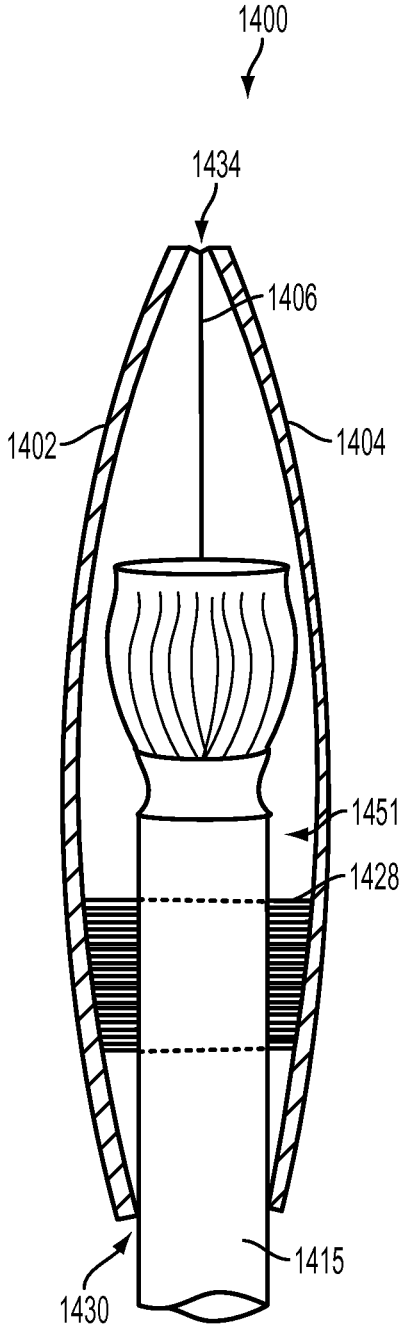

FIGS. 32A-34 depict a brush cover 1400 in accordance with another non-limiting embodiment. FIG. 32A depicts a side elevational view of a first panel 1402. FIG. 32B shows an elevational view of a second panel 1404. FIG. 32C depicts a cross-sectional view of the brush cover of FIG. 32B taken along line 32C-32C. FIGS. 33-34 show cross-sectional views of the brush cover 1400 storing various sizes of makeup brushes.

Referring first to FIGS. 32A-32C, the front panel 1402 and second panel 1404 may be stitched, or otherwise attached, along attached portion 1408 to form a seam 1406 (FIG. 32C). The first and second panels 1402, 1404 cooperatively define a first opening 1430 and a second opening 1434 that are in communication with an internal pocket 1410. The brush cover 1400 may have a retention portion 1460 positioned proximate the first opening 1430 that comprises a first elastic member 1428 and a second elastic member 1429. Each of the first and second elastic members 1428, 1429 may be coupled to the front and second panels 1402, 1404. In some embodiments, the first and second elastic members 1428, 1429 are stitched or glued to the front and second panels 1402, 1404. The elastic members may be coupled, for example, to either the inside or outside face of the first and second panels. In some embodiments, the first and second panels 1402, 1404 may be multilayered, with the elastic members coupled to an internal layer. In any event, the first and second elastic members 1428, 1429 are expandable to change the size of the first opening 1430 and the size of pocket 1410. While a fastener is not shown, it is to be appreciated that some embodiments may incorporate a fastener to selectively close or seal the second opening 1434. Moreover, while attached portion 1408 is illustrated as extending substantially along the seam 1406 from the second opening 1434 to the first and second elastic members 1428, 1429, some other embodiments may have smaller or shorter attached portions 1408. For example, some brush covers may only be attached at an area immediately proximate the second opening 1434. As is to be appreciated, having a smaller or shorter attached portion 1408 may allow for greater expansion of the pocket 1410. Nevertheless, the amount of expansion may still be limited by the amount of expansion (i.e., elasticity) permitted by the retention portion 1460. In fact, the particular arrangement of attached portion sizing, retention portion sizing, and elasticity may be selected based on the type or size of makeup brush to be housed by the brush cover. Brush covers for relatively small makeup brushes (such as eye makeup brushes, for example) may be configured differently than brush covers for larger style brushes. In any event, due to the expansive characteristics of the retention portion 1460, a variety of makeup brush styles can be stored by the same brush cover. In fact, in some cases, a plurality of makeup brushes can be simultaneously stored within the same brush cover.

FIGS. 33-34 illustrates the brush cover 1400 accommodating two different makeup brushes 1450, 1451, respectively. As shown, in FIG. 33, a makeup brush 1450 having a relatively slender handle 1414 is secured within the brush cover 1400 due to the biasing forces exerted against the handle 1414 by the first elastic member 1428 and the second elastic member 1429 (FIG. 32B). By comparison, the makeup brush 1451 shown in FIG. 34 has a relatively large diameter handle 1415. The brush cover 1400 is expanded to accommodate the larger sized makeup brush, which is held in placed by the first elastic member 1428 and the second elastic member 1429 (FIG. 32B).

FIGS. 35-40 illustrate front view and back views of example brush cover configurations. As is to be appreciated, various components or features of one of the illustrated brush covers may be used in combination with or in place of features from other brush covers. As such, the particular configurations illustrated herein are not intended to be limiting, but instead are used merely to depict example features of elements of example brush covers.

Figure 35:
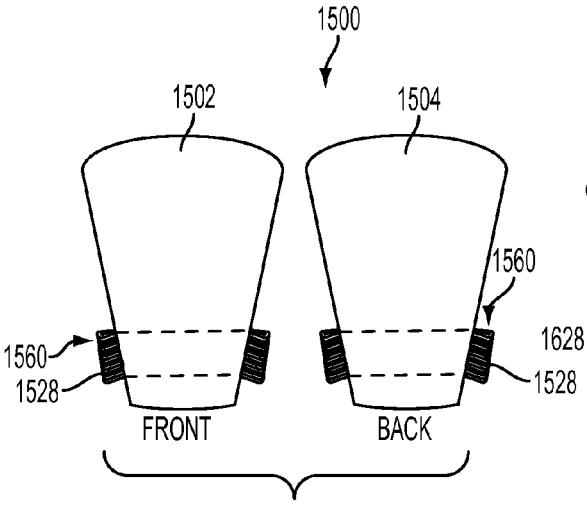
FIGS. 35-40 depict front and back views of example brush cover configurations.

FIG. 35 depicts a brush cover 1500 having a first panel 1502 and a second panel 1504. The first and second panels 1504 may be coupled to a form an expandable pocket. A retention portion 1560 may allow for such expansion. The retention portion in FIG. 35 has an elastic band member 1528 which is circular band coupled to the first and second panels 1502, 1504.

Figure 36:
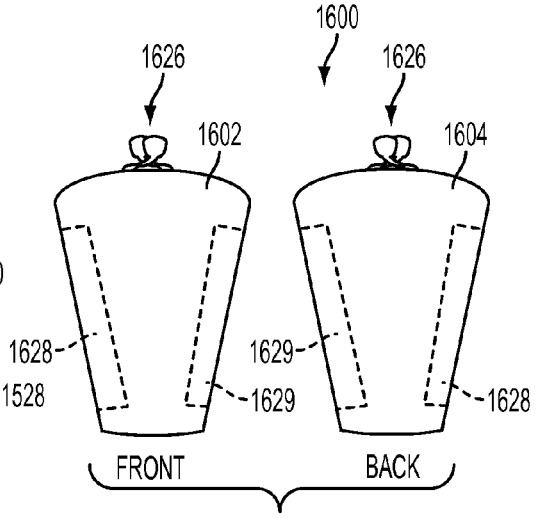

FIG. 36 depicts a brush cover 1600 having a first panel 1602 and a second panel 1604. The brush cover 1600 comprises a first and second elastic member 1628, 1629 which generally extend from the top to the bottom of the brush cover. The first and second elastic members 1628, 1629 allow for the expansion of a pocket formed by the first and second panels 1602, 1604 and help to secure a makeup brush positioned within the brush cover 1600. The brush cover 1600 also comprises a fastener 1626 which selectively holds the brush cover in a closed position.

Figure 37:
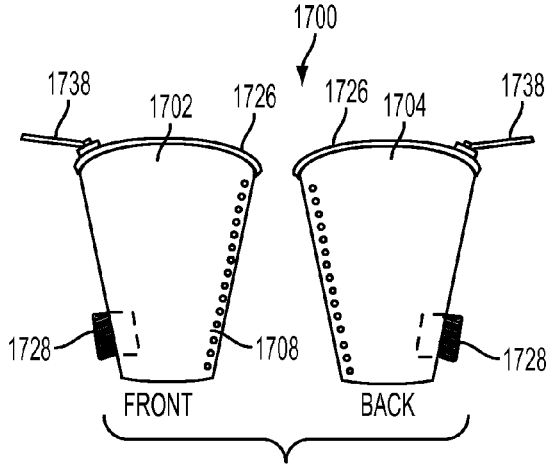

FIG. 37 depicts a brush cover 1700 in accordance with one non-limiting embodiment. The brush cover 1700 has a first panel 1702 coupled to a second panel 1704 along panel stitching 1708. Other embodiments may use other types of panel couplings, such as glue or rivets, for example. A zipper 1726 with a zipper pull 1738 is positioned near an opening of the brush cover 1700. The brush cover 1700 also comprises an elastic member 1728 positioned on the opposite side of the panel stitching 1708. The elastic member 1728 may be configured to provide the biasing force to generally maintain the position of a makeup brush inserted into the brush cover 1700. In some embodiments, first and second panels 1702, 1704 are a unitary panel which is folded. In such embodiments, the panel stitching 1708 may not necessarily be needed.

Figure 38:
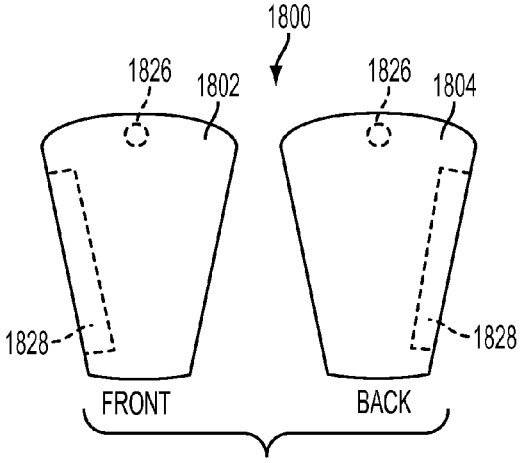
Figure 42:
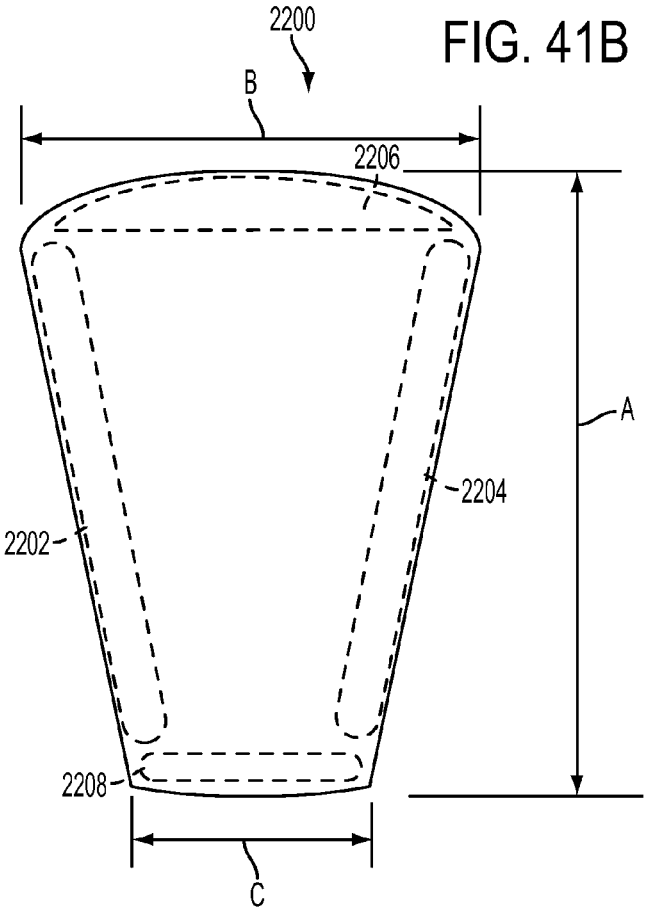
FIG. 42 depicts an example brush cover.

FIG. 38 depicts a brush cover 1800 that comprises a single elastic member 1828 coupled to a first panel 1802 and a second panel 1804. The first panel 1802 and the second panel 1804 may be coupled together, such as stitched or glued along a second side region 2204 (FIG. 42). In some embodiments, the first and second panels 1802, 1804 are a unitary panel which is folded. A fastener 1826, such as a magnetic snap, for example, may be used to hold a portion of the first panel 1802 in close proximity to the second panel 1804.

Figure 39:
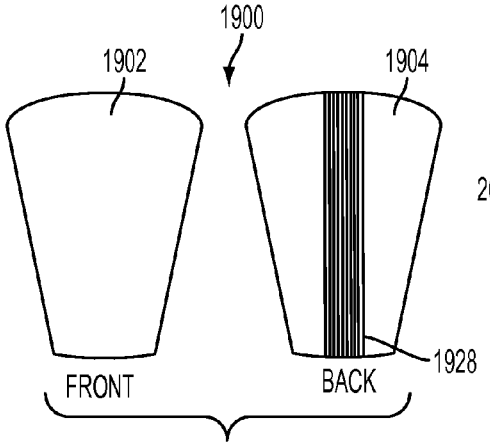

FIG. 39 depicts a brush cover 1900 comprising a first panel 1902 and a second panel 1904. An elastic member 1928 is positioned within the panel 1904. While the elastic member 1928 is shown extending from the top of the panel 1904 to the bottom of the panel 1904, the present disclosure is not so limited. Furthermore, while not shown, it is to be appreciated that the brush cover 1900 may also comprise any suitable fastener. While the elastic member 1928 is illustrated as a relatively narrow strip, in other embodiments, the elastic member 1928 may be much wider such that a majority of the second panel 1904 is the elastic member 1928. Furthermore, some embodiments may have multiple elastic members 1928 incorporated into the one or both of the first and second panels 1902, 1904.

Figure 40:
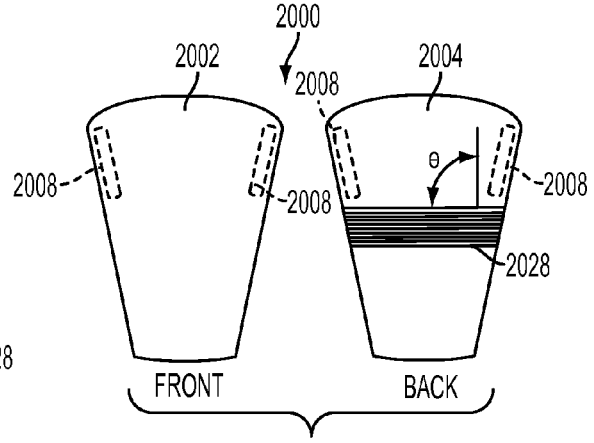

FIG. 40 depicts a brush cover 2000 having a first panel 2002 and a second panel 2004. An elastic member 2028 is positioned laterally across the second panel 2004. The elastic member 2008 may be positioned at an angle θ relative to vertical. In the illustrated embodiment, angle θ is about 90 degrees. In other embodiments, angle θ may be in the range of about 0 degrees to 90 degrees. While the elastic member 2028 is illustrated as a relatively narrow strop, in other embodiments, the elastic member 2028 may be much wider such that a majority of the second panel 2008 is the elastic member 2028. The first panel 2002 and the second panel 2004 may be coupled using panel stitching 2008, or any other suitable coupling technique.

Figure 41A:
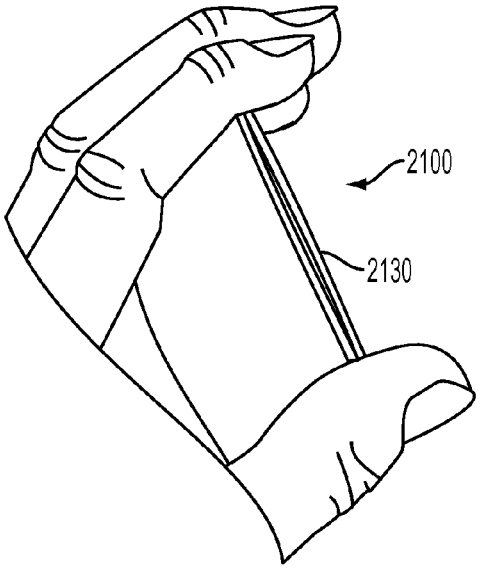
FIG. 41A-41B depict a brush cover having a squeeze-type opening.
Figure 41B:
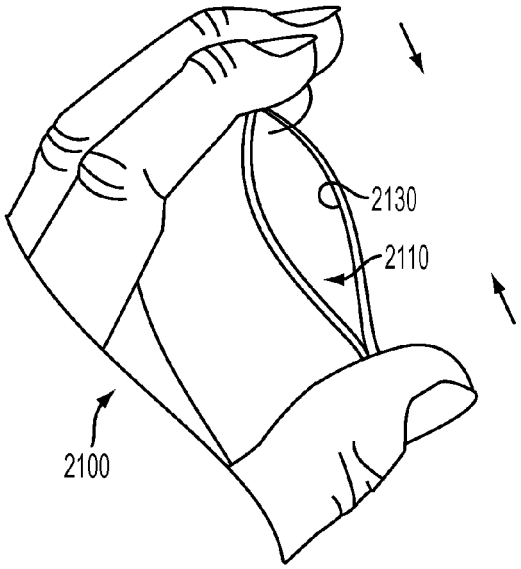

FIG. 41A-41B depict a brush cover 2100 having a squeeze-type opening (sometimes referred to as "self-closing" or "coin purse" opening) at its opening 2130. As is to be appreciated, this squeeze-type opening can alternatively be used with a variety of other embodiments, such as in place of the zipper 1126 (FIG. 29) or the fastener 1226 (FIG. 30), for example. When the brush cover 2100 is squeezed in the direction of the arrows, the opening 2130 separates to transition from a closed position (FIG. 41A) to an open position (FIG. 41B) allowing access to an inner pocket 2110. When the user releases the brush cover 2100, the opening 2130 may automatically close. While not shown, it is to be appreciated that the brush cover 2100 may also comprise a retention portion comprising an elastic band, or other suitable retention mechanism, to engage the handle of a makeup brush. This retention portion may be similar to any of the retention portions 960, 1060, 1160, 1260, 1360, 1460 shown in FIGS. 23, 28, 29, 30, 31, and 32A, respectively. Any suitable technique may be used to produce the squeeze-type opening at the opening 2130. For example, the brush cover 2100 may have a flexible plastic opening, similar to common coin purses. Other embodiments, may include bendable strips of plastic or metal strips positioned or embedded along the rim of the first opening 2130. By squeezing the ends of the strips, the strips bend or flex outward to allow access to the pocket. When the ends of the strips are released, they flex back to their original shape to close the opening 2130.

FIG. 42 depicts an example brush cover 2200 having first side region 2202, a second side region 2204, a top region 2206, and a bottom region 2208. The brush cover 2200 has a height A, a first width B and a second width C. In accordance with various embodiments, the height A may be in the range of about 1 inch to about 5 inches, the first width B may be in the range of about 0.5 inches to about 4 inches, and the second width C may be in the range of about 0.5 to about 4 inches. In some embodiments, the height A may exceed 5 inches and the first and/or second width B and C may exceed 4". In some embodiments, the first width B and the second width C are about equal. In other embodiments, the first width B is larger than the second width C to form a brush cover 2200 that generally narrows from top to bottom. With embodiments that narrow from top to bottom, in some of those embodiments, the second width C is about 30% less than the first width B. In some of those narrowing embodiments, the second width C is about 50% less than the first width B. In some of those narrowing embodiments, the second width C is about 25% less than the first width B. The depth of the brush cover 2200 may be in the range of about 0.25 inches to about 1 inch, although some embodiments may be thinner or thicker depth without departing from the scope of the present disclosure.

Figure 43A:
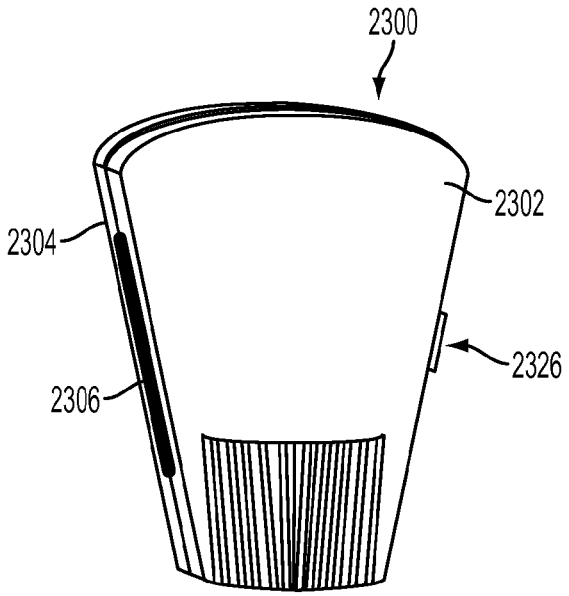
FIG. 43A-43C depicts an example progression of opening a brush cover.
Figure 43B:
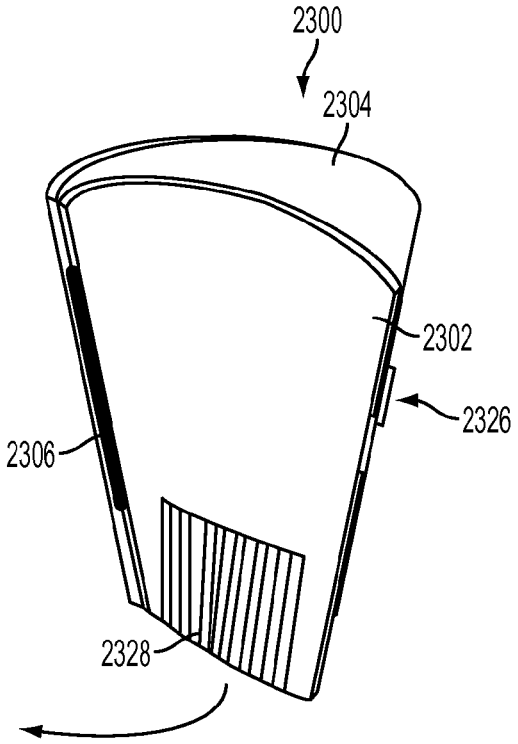
Figure 43C:
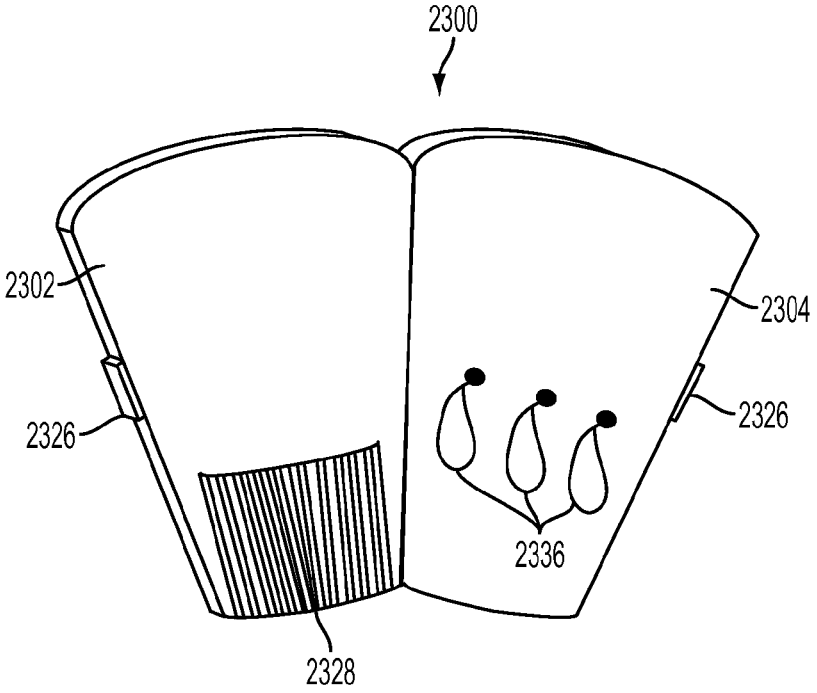

FIG. 43A-43C depicts an example progression of opening a brush cover 2300. The brush cover 2300 has a first panel 2302 and a second panel 2304 that are coupled to each other in a hinged arrangement. A fastener 2326 is positioned to selectively maintain the brush cover 2300 in a closed position. The fastener 2326 may be any suitable closure device, such as a snap, button, zipper, clasp, and so forth. A hinge 2306 may be positioned along one side of the brush cover 2300. The hinge 2306 may be any suitable component or structure allowing the first panel 2302 to pivot relative to the second panel 2304. For instance, the hinge 2306 can be made from plastic, fabric, synthetic material, or an expandable material, as elastic. In some embodiments, the hinge 2306 may be combination of interlocking rigid components. In other embodiments the hinge 2306 may be relatively simple, such as a single flexible piece of material that is fastened to each of the first and second panels 2302, 2304. In some embodiments, the first panel 2302 and the second panel 2304 are formed from a single unitary panel that is folded such that the fold forms the hinge 2306. In some embodiments, such as brush covers manufactured through injection molding process, the hinge is a living hinge and integral with both the first and second panels 2302, 2304. In any event, the brush cover 2300 may also comprise an elastic member 2328. While the elastic member 2328 is shown positioned on the first panel 2302, this disclosure is not so limited. Instead, the elastic member 2328 may be arranged in any suitable configuration. FIG. 43A shows the brush cover 2300 in a closed position. FIG. 43B shows the brush cover 2300 as the first panel 2302 is pivoted about the hinge 2306 in the direction indicated by the arrow. FIG. 43C shows the brush cover 2300 in a fully opened position. In one embodiment, as shown, one or more loops 2336, or other interior retention devices, may be mounted to the second panel 2304 for receiving makeup brush handles. While three loops 2336 are illustrated in FIG. 43C, any suitable number of loops (having the same or different shapes and sizes) may be used. The loops 2336 also may be expandable, flexible, or rigid. The loops 2336 may be attached to the second panel 2304 using any suitable technique. For example, in some embodiments, the loops 2336 may be stitched onto the inner surface of the second panel 2304 or riveted to the inner surface of the second panel 2304. It is noted that some embodiments of the brush cover 2300 may not include any loops or other interior retention device.

Figure 44A:
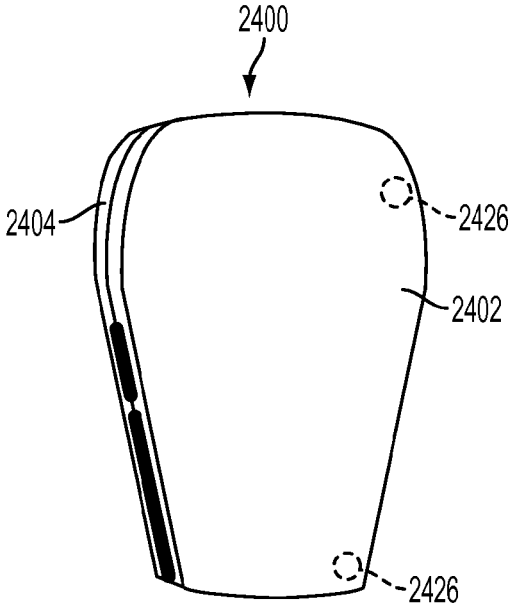
FIG. 44A-44C depict an example progression of opening a brush cover.
Figure 44B:
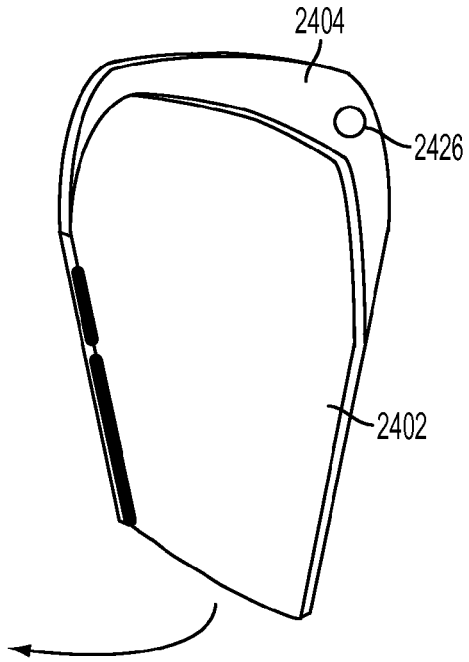
Figure 44C:
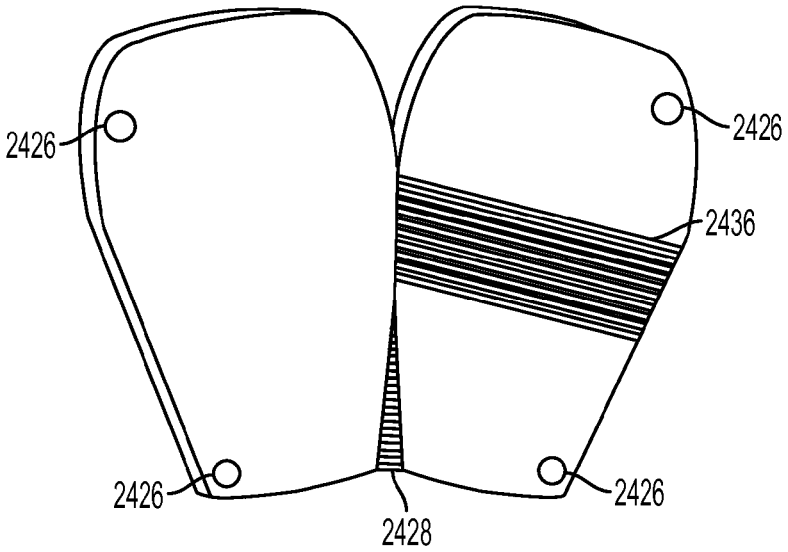

As shown by the brush cover 2400 in FIGS. 44A-44C, some embodiments may utilize other interior retention devices, such as an elastic strap 2436, for example. The brush cover 2400 has a first panel 2402 in hinged communication with a second panel 2404. One or more fasteners 2426 may be used to maintain the brush cover 2400 in a closed position. In one embodiment, the fasteners 2426 are magnetic and positioned such that they are not necessarily visible, such as internal to the panels 2402, 2402. As shown in FIG. 44B, the first panel 2402 can be pivoted about the hinge to allow access to the brush cover 2400. The elastic strap 2436 may be coupled to the second panel 2404 such that a handle of a makeup brush can be slide between the elastic strap 2436 and the second panel 2404. In some embodiments, one or more elastic members 2428 may also be positioned between the first and second panels 2402, 2404 to help secure the makeup brush in place. Additionally, the elastic strap 2436 may be secured to the second panel 2404 at a plurality of locations along the strap so that a series of loops are formed, which can each receive the handle of a different makeup brush.

Figure 45A:
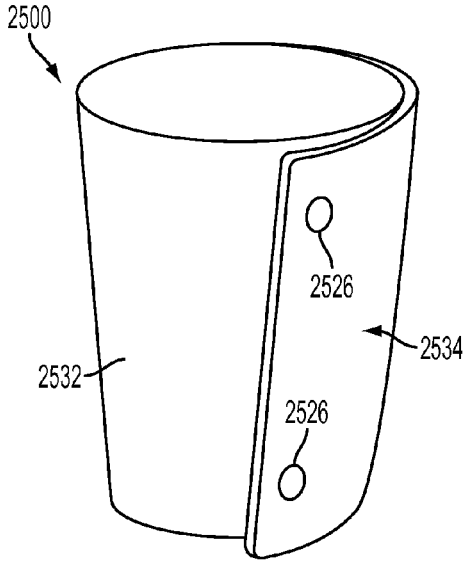
FIG. 45A-45B depict a brush cover in a closed and open position, respectively.
Figure 45B:
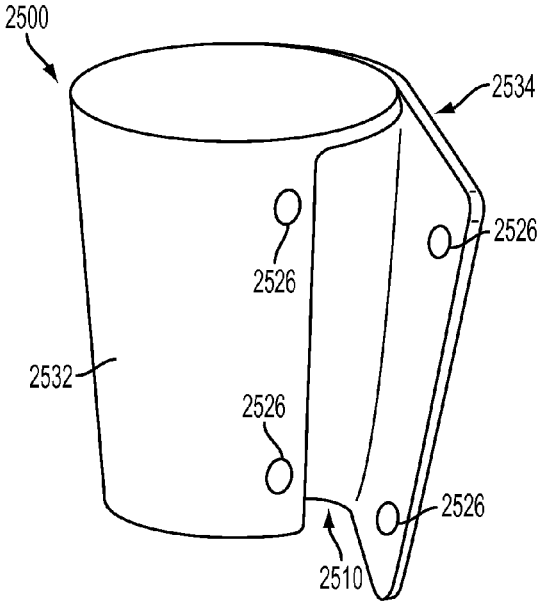

FIGS. 45A-45B depict an embodiment of brush cover 2500 in a closed position and an open position, respectively. The brush cover 2500 comprises a body flap 2534 with a portion of the body flap 2534 that can be selectively coupled and decoupled to the body 2532 using fasteners 2526. The fasteners 2526 may be snaps, buttons, magnetic clasps, or hook and loop fasteners, for example. When the portion of the body flap 2534 is decoupled from the body 2532, the pocket 2510 that formed by the body 2532 is accessible to allow a makeup brush to be inserted therein. Once the makeup brush has been inserted, the portion of the body flap 2534 can again be coupled to the body 2532. It is to be appreciated, that the brush cover 2500 may also include a variety of features described herein, such as a hinged lid, one or more internal loops, a retention portion, and so forth.

Figure 46A:
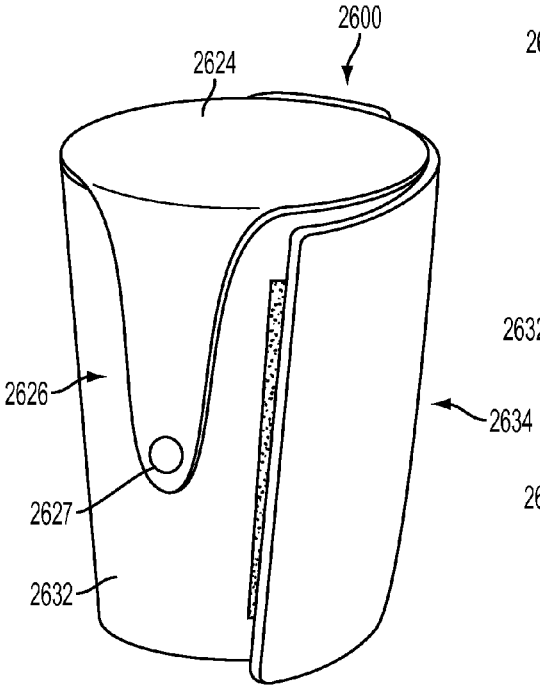
FIG. 46A-46B depict a brush cover in a closed and open position, respectively.
Figure 46B:
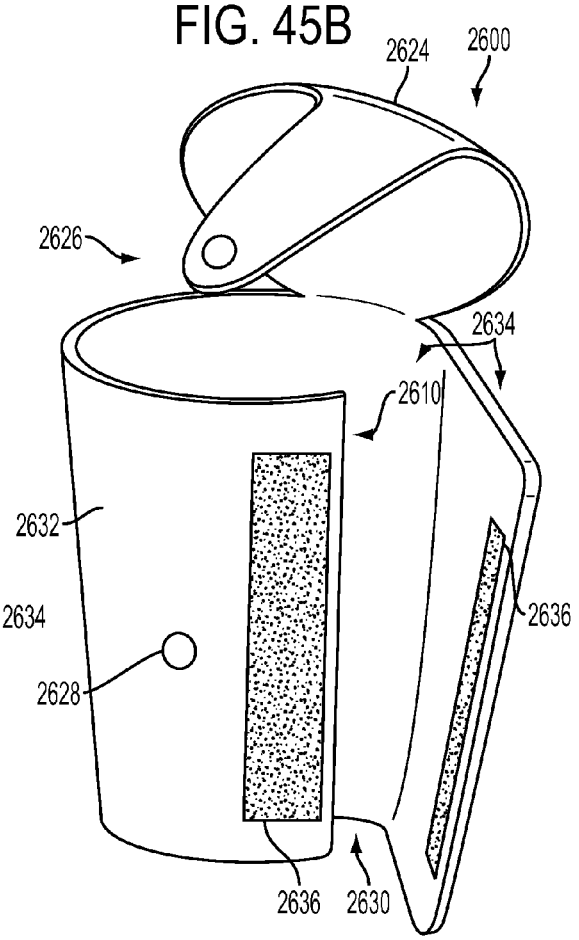

FIGS. 46A-46B depict an embodiment of brush cover 2600 in a closed position and an open position, respectively. The brush cover 2600 comprises a body flap 2634 that can be selectively coupled and decoupled to the body 2632 using fasteners 2626. The particular location or orientation of the body flap 2634 relative to the body 2632 may vary. While the body flap 2634 is shown positioned on the side of the brush cover 2600, other embodiments may position the body flap 2634 toward the rear (i.e., near the hinge of the lid 2624, for example) without departing from the scope of the present disclosure. In the illustrated embodiment, the fasteners 2636 are hook-and-loop fasteners which allow for the body flap 2634 to be selectively coupled to the body 2632 at a plurality of positions to change the size of the pocket 2610. In other embodiments, different types of fasteners 2636 may be used, such as magnetic snaps, buttons, and so forth. Changing the size of the pocket 2610 allows for the accommodation of makeup brushes of different sizes. The brush cover 2600 also comprises a lid 2624 in hinged communication with the body 2632. In some methods of use, the body flap 2634 may be attached to the body 2632 to create a pocket appropriately sized for a particular brush or type of brush. Subsequently, the lid 2624 may be used as the primary means for accessing the pocket 2610.

The lid 2624 comprises a tab 2626 that selectively couples to the body 2632. In one embodiment, a first magnetic clasp 2627 is coupled to the tab 2626 and a second magnetic clasp 2628 is coupled to the body 2632. When the lid 2624 is in the closed position (FIG. 46A), the first magnetic clasp 2627 is positioned proximate to and engages with the second magnetic clasp 2628, which generally holds the lid 2624 in the closed position. In some embodiments, the first and second magnetic clasps 2627, 2628 may be positioned along the body 2632 such that they are proximate to the handle (or ferule) of a stored makeup brush (as opposed to be positioned proximate to the head of the makeup brush). Such placement may reduce the likelihood of the head of makeup brush being distorted over time. In some embodiments, the first and second magnetic clasps 2627, 2628 may be positioned closer to the first opening 2630 than the second opening 2634. It is noted that the placement of the first and second magnetic clasps 2627, 2628 illustrated in FIGS. 46A-46B can be associated with any other type of tab or lid, such as the magnetic flap 626 shown in FIG. 22 or tab 126 shown in FIGS. 4-9, for example.

Figure 47A:
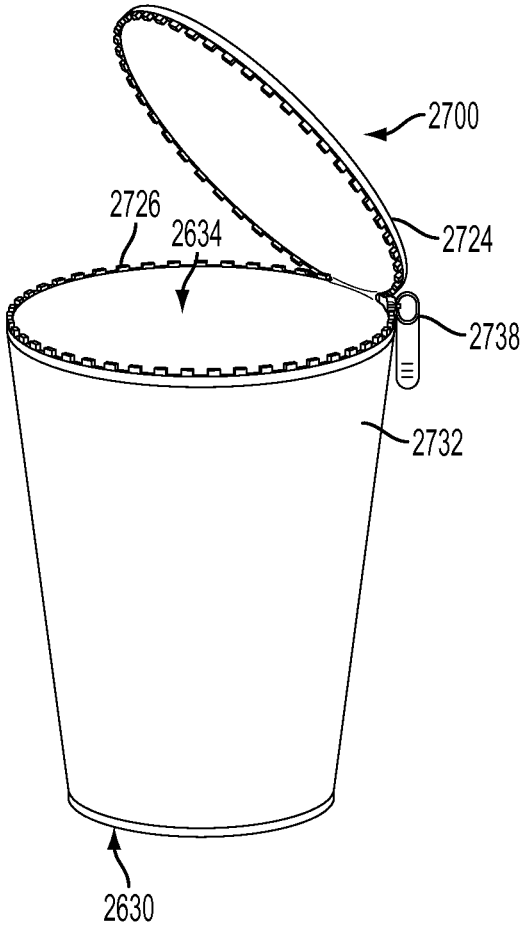
FIG. 47A-47B depict a brush cover in an open and closed position, respectively.
Figure 47B:
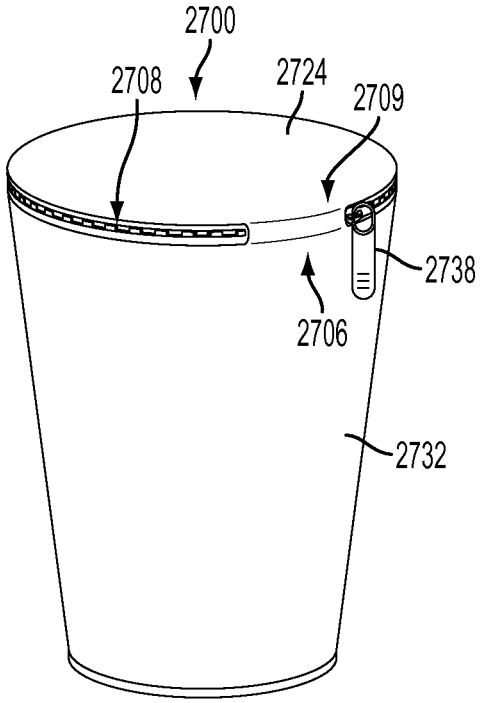

FIGS. 47A-47B depict an embodiment of brush cover 2700 with a lid 2724 in an open position and a closed position, respectively. The brush cover 2700 comprises a body 2732 defining a first opening 2630 and a second opening 2634. A zipper 2726 with a zipper pull 2738 is coupled to the lid 2724, which is in hinged communication with the body 2732 by hinge 2706. The hinge 2706 may have a first end 2708 and a second end 2709. The zipper 2726 comprising a first arcuate row of zipper teeth coupled to the lid 2724 and extending from a first end 2708 of the hinge 2706 to the second end 2709 of the hinge 2706. The zipper 2726 may also comprise a second arcuate row of zipper teeth coupled to the body 2732 proximate the second opening 2634. The lid 2724 may be unzipped and opened to allow access to the second opening 2643. Once the head of a makeup brush has been positioned within the brush cover 2700, the lid 2724 can be closed and secured to the body 2732 using the zipper 2726.

Figure 48A:
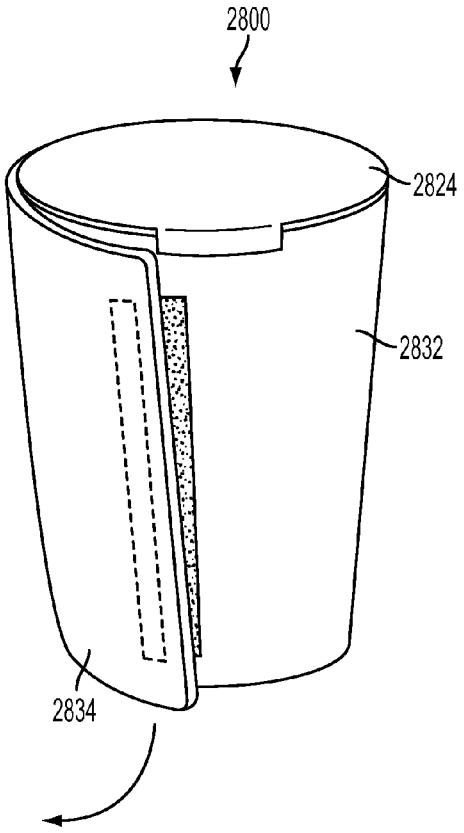
FIG. 48A-48B depict a brush cover in an open and closed position, respectively.
Figure 48B:
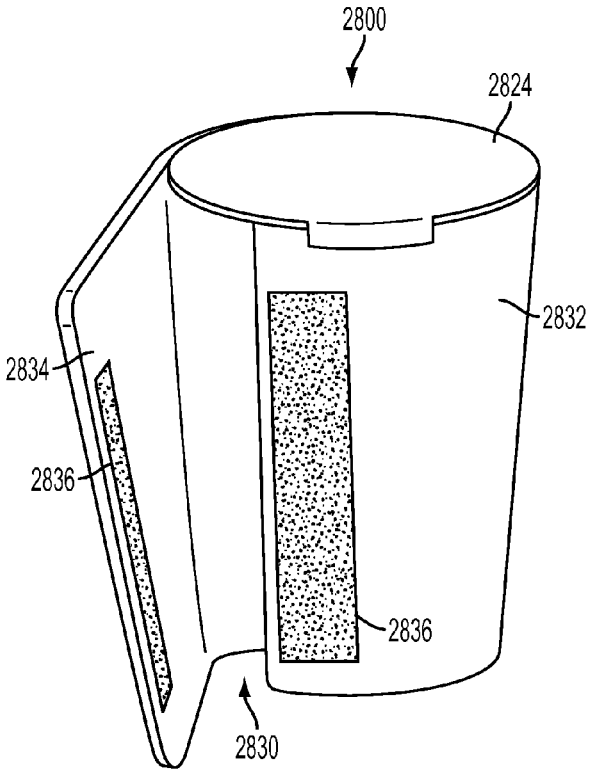

FIGS. 48A-48B depict rear views of a brush cover 2800 with a body flap 2834 in a closed position and an open position, respectively. The body flap 2834 can be selectively coupled and decoupled to the body 2832 using fasteners 2836. In the illustrated embodiment, the fasteners 2836 are hook-and-loop fasteners which allow for the body flap 2834 to be selectively coupled to the body 2832 at a plurality of positions to change the size of the pocket 2630. Other embodiments may use other type of fasteners or fastening techniques. Changing the size of the pocket 2630 allows for the brush cover 2800 to be selectively sized to accommodate of makeup brushes of different sizes. The brush cover 2800 also comprises a lid 2824 in hinged communication with the body 2632 that moveable between a closed and open position (shown in the closed position). The lid 2824 can include any suitable structure to maintain the lid 2824 in a closed position, such as a tab (such as tab 2626 in FIG. 46A) or a zipper (such as zipper 2726 in FIG. 47A), for example. In some methods of use, the body flap 2834 may be attached to the body 2832 to create a pocket 2630 appropriately sized for a particular brush or type of brush to be routinely stored within the brush cover 2800. Subsequently, the lid 2824 may be used as the primary means for accessing the pocket 2610.

Figure 49A:
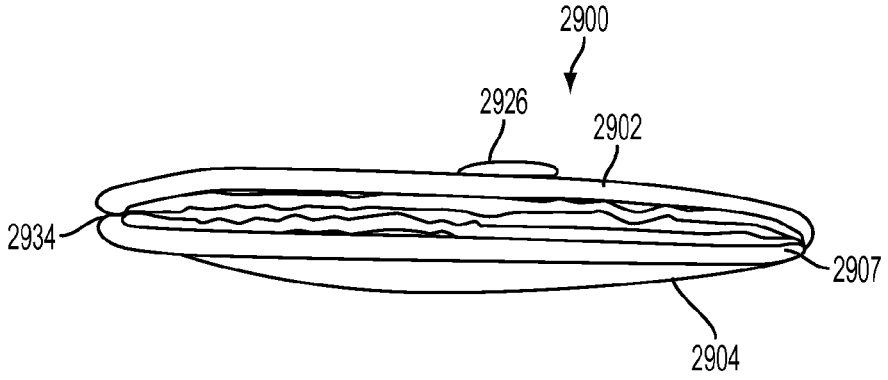
FIGS. 49A-49C depict a brush cover in accordance with an example embodiment.
Figure 49B:
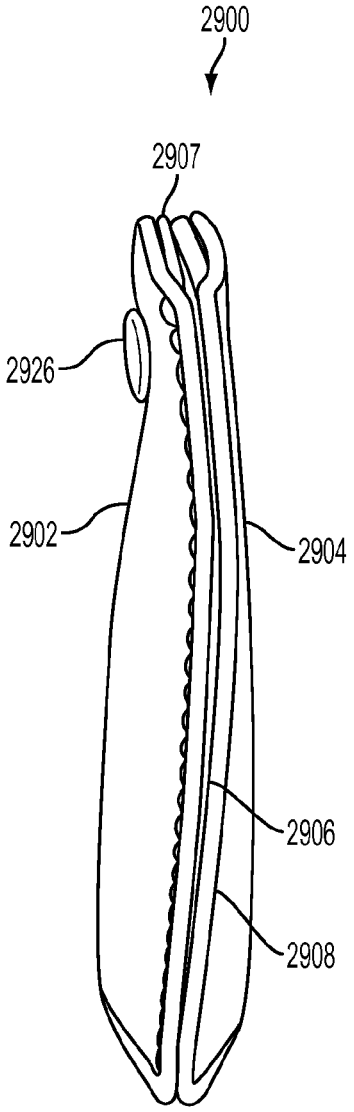
Figure 49C:
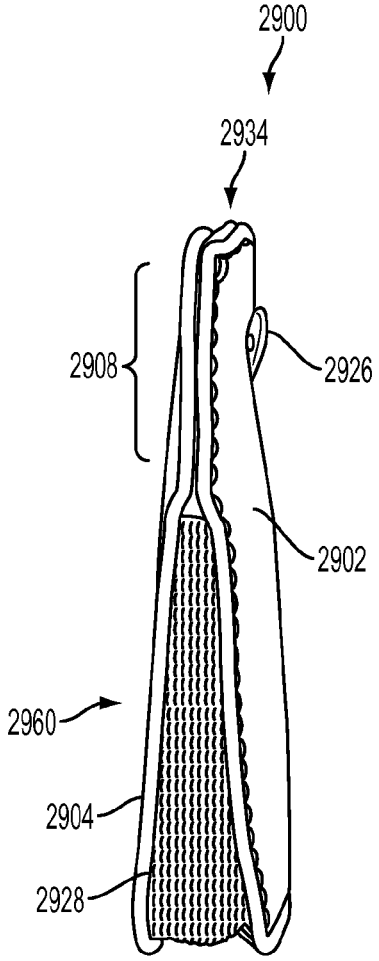

As is to be appreciated, the brush covers having body flaps (brush covers 2500, 2600, 2800), as well as any other style of brush cover described herein, may incorporate internal retention features, such as interior loops. In fact, some embodiments may have a plurality of interior loops, similar to interior loops 838 (FIG. 17-18), for example, such that a plurality of makeup brushes can be simultaneously stored within in the brush cover. Each of the interior loops can be of similar size or of different size. FIGS. 49A-49C depict a brush cover 2900 in accordance with an example embodiment. FIG. 49A shows a top view of the brush cover 2900 and FIGS. 49B-C show a first and second side view, respectively. The brush cover 2900 has a first panel 2902 coupled to a second panel 2904. A fastener 2926, shown as a snap, is positioned proximate an opening 2934 to selectively retain the opening 2934 in a closed position. A liner 2907 is positioned in the inner cavity of the brush cover 2900 to line the pocket that is cooperatively defined by the first and second panels 902, 904. Panel stitching 2908 is used to couple the first panel 2902 and the second panel 2904. As shown in FIG. 49B, the panel stitching 2908 generally extends vertically along the entire seam 2906 of the brush cover 2900. On the other side, shown in FIG. 49C, the panel stitching 2908 only extends from the opening 2934 to the retention portion 2960. The retention portion 2960 comprises an elastic member 2928 that is coupled to both the first panel 2902 and the second panel 2904. The elastic member 2928 allows the first panel 2902 to separate from the first panel 2904 in order to store a makeup brush within the brush cover 2900. Having shown and described various versions of the protective brush cover, further adaptations of the methods and systems described herein may be accomplished by appropriate modifications by one of ordinary skill in the art without departing from the scope of the protective brush cover. Several of such potential modifications have been mentioned, and others will be apparent to those skilled in the art. For instance, the examples, versions, geometrics, materials, steps, and the like discussed above are illustrative and are not required. Accordingly, the scope of the protective brush cover should be considered in terms of the following claims and is understood not to be limited to the details of structure and operation shown and described in the specification and drawings.

What is claimed is:

1. A brush cover for storing a makeup brush, comprising:

a first panel;

a second panel hingedly coupled to the first panel such that the first panel is movable between a first position and a second position relative to the second panel;

a fastener configured to selectably maintain the first panel in the first position relative to the second panel;

a pocket cooperatively defined by the first and second panels when the first panel is in the first position, the pocket having an upper portion and a lower portion, the upper portion having a first width and the lower portion having a second width, wherein the first width of the upper portion is larger than the second width of the lower portion;

wherein the first and second panels define an opening in communication with the lower portion of the pocket when the first panel is in the first position; and wherein one or more of the first and second panels comprises a retention portion positioned proximate to the opening, the retention portion configured to exert a biasing force when the first panel is in the first position.

2. The brush cover of claim 1, wherein the fastener is positioned proximate to the upper portion of the pocket.

3. The brush cover of claim 2, wherein the fastener is selected from the group consisting of a snap, a button, a zipper, a magnetic snap, a button snap, a hook-and-loop fastener, a clasp, and a latch.

4. The brush cover of claim 1, comprising:

a panel coupling, wherein the panel coupling hingedly couples the first panel and the second panel.

5. The brush cover of claim 1, wherein the retention portion comprises an elastic member.

6. The brush cover of claim 5, wherein the elastic member is coupled to the first panel and the second panel.

7. The brush cover of claim 5, wherein at least one of the first panel and the second panel comprises the elastic member.

8. The brush cover of claim 1, wherein the first panel and the second panel form a seam and the retention portion is positioned proximate to the seam.

9. The brush cover of claim 1, comprising an internal retention device.

10. The brush cover of claim 9, wherein the internal retention device is a loop.

11. The brush cover of claim 10, wherein the loop is expandable.

12. The brush cover of claim 10, wherein the loop is flexible.

13. The brush cover of claim 10, wherein the loop is rigid.

14. The brush cover of claim 1, wherein the fastener is a zipper.

15. The brush cover of claim 1, wherein the first position is a closed position and the second position is an open position.

16. The brush cover of claim 4, wherein the panel coupling is selected from the group consisting of glue, stitching, and rivets.

17. The brush cover of claim 4, wherein the first panel comprises a first side and a second side;

wherein the second panel comprises a first side and a second side;

wherein the panel coupling is a hinge coupled to the first side of the first panel and the first side of the second panel; and wherein the fastener comprises a first portion and a second portion, the first portion of the fastener is coupled to the second side of the first panel and the second portion of the fastener is coupled to the second side of the second panel.

18. The brush cover of claim 4, further comprising a flexible internal retention loop;

wherein the first panel comprises a first side and a second side;

wherein the second panel comprises a first side and a second side;

wherein the panel coupling is coupled to the first side of the first panel and the first side of the second panel; and wherein the fastener is a zipper, the zipper comprises a first portion and a second portion, wherein the first portion of the zipper is coupled to the second side of the first panel and the second portion of the zipper is coupled to the second side of the second panel.

* * * * *